US011292705B2

(12) United States Patent
Rillema et al.

(10) Patent No.: US 11,292,705 B2
(45) Date of Patent: Apr. 5, 2022

(54) CAPPING CHUCK ASSEMBLY FOR A FILLER, A CAPPER AND A FILLER HAVING A CAPPING CHUCK ASSEMBLY

(71) Applicant: FOGG FILLER COMPANY, LLC, Holland, MI (US)

(72) Inventors: Larry Rillema, Zeeland, MI (US); Zach De Windt, Wyoming, MI (US); Kenneth Kreuze, Holland, MI (US)

(73) Assignee: FOGG FILLER COMPANY, LLC, Holland, MI (US)

( * ) Notice: Subject to any disclaimer, the term of this patent is extended or adjusted under 35 U.S.C. 154(b) by 0 days.

(21) Appl. No.: 16/932,024

(22) Filed: Jul. 17, 2020

(65) Prior Publication Data

US 2022/0017343 A1 Jan. 20, 2022

(51) Int. Cl.
*B67B 3/20* (2006.01)

(52) U.S. Cl.
CPC ..... *B67B 3/20* (2013.01); *B67B 3/2013* (2013.01); *B67B 3/2033* (2013.01)

(58) Field of Classification Search
CPC ..... B67B 3/20–2033; B67B 3/2073–2093; B65B 7/28–2842
See application file for complete search history.

(56) References Cited

U.S. PATENT DOCUMENTS 5,467,527 A * 11/1995 Zanini ..... B67B 3/2033 29/240
2014/0311089 A1* 10/2014 Scott ..... B67B 3/2066 53/331.5
2019/0177145 A1* 6/2019 Caffa ..... B67B 3/2066

* cited by examiner

*Primary Examiner* — Anna K Kinsaul
*Assistant Examiner* — Himchan Song
(74) *Attorney, Agent, or Firm* — Thompson Hine LLP

(57) ABSTRACT

A capping chuck assembly having a chuck housing, a retaining assembly and a cap gripping assembly. The chuck housing receives a cap and has longitudinal axis of rotation. The retaining assembly includes a plurality of retaining jaws and a biasing member. The retaining jaws are movable radially, with biasing member inwardly biasing the jaws. The cap gripping assembly includes a plurality of gripper assemblies spaced apart from each other about the axis. Each gripper assembly has a cam arm rotatably mounted to the chuck housing with a lever arm portion extending toward the axis of rotation configured to rotate relative to the cap receiving opening. An engaging jaw is coupled to the gripper assembly. Rotation of the cam arm away from the cap receiving opening directs the engaging jaw radially toward the axis of rotation. An ejection assembly is disclosed as well as a method of retaining a cap.

18 Claims, 20 Drawing Sheets

CAPPING CHUCK ASSEMBLY FOR A FILLER, A CAPPER AND A FILLER HAVING A CAPPING CHUCK ASSEMBLY

CROSS-REFERENCE TO RELATED APPLICATION

N/A

BACKGROUND OF THE DISCLOSURE

1. Field of the Disclosure

The disclosure relates in general to bottle and other container capping equipment, and more particularly, to a capping chuck assembly for a filler.

2. Background Art

The filling and capping of bottles and other containers is known in the art. Among other solutions are threaded bottles that receive caps having mating threads on an inside surface thereof. Typically, these caps are picked up by a capping chuck and applied onto a bottle.

With increases in speed of bottle fillers (and consequently cappers) and the decrease in the quantity of plastic used for making caps (and often bottles), reliably applying a cap to a bottle has become increasingly difficult. For example, due to the increase in the speed of the operations, there is less margin for error to preclude the marring or damaging of a cap. Additionally, with less material forming the cap (i.e., thinner walls and cap features), handling of the cap has become increasingly difficult to achieve without marring or damaging the cap.

With these changes, it nevertheless remains important to reliably grasp a cap that may be in a range of positions at the pickup point, and that may vary slightly in size and configuration. For example, vary cap position at pickup by only thousands of an inch can result in marring of the cap, or, worse, the failure entirely of grasping the cap. Additionally, if a cap has outer knurls or other configurations, the structures that preclude rotation of the cap within the capping chuck during tightening can also cause damage to the cap during pickup, tightening or release. As the speeds increase, and the caps become lighter and thinner, such possibility for damage only increases.

SUMMARY OF THE DISCLOSURE

The disclosure is directed to a capping chuck assembly comprising a chuck housing, a retaining assembly and a cap gripping assembly. The chuck housing defines a central bore and a cap receiving opening and is structurally configured to receive a cap through the cap receiving opening. The chuck housing having an axis of rotation extending longitudinally therethrough.

The retaining assembly is coupled to the chuck housing, the retaining assembly and includes a plurality of retaining jaws and a biasing member. The plurality of retaining jaws each have an inner side positionable within the central bore. The retaining jaws are movable at least radially inwardly and outwardly toward and away from an axis of rotation. The biasing member is configured to inwardly biasing the retaining jaws toward the axis of rotation.

The cap gripping assembly is coupled to the chuck housing, and positioned on a side opposite the cap receiving opening from the retaining assembly. The cap gripping assembly includes a plurality of gripper assemblies spaced apart from each other about the axis of rotation within the chuck housing. Each gripper assembly has a cam arm rotatably mounted to the chuck housing with a lever arm portion extending toward the axis of rotation configured to rotate toward and away from the cap receiving opening. An engaging jaw is coupled to the gripper assembly. Rotation of the cam arm away from the cap receiving opening directs the engaging jaw radially toward the axis of rotation.

In some configurations, the plurality of retaining jaws have an inner side that is smooth and substantially free of surface deformations.

In some configurations, the cap engaging jaw further includes a cap engaging surface having at least one surface deformation structurally configured to engage a knurling of a cap, to, in turn, limit relative rotation of the cap engaging jaw and the cap.

In some configurations, the cap engaging jaws further include a disengaged configuration wherein the cap engaging surfaces of the cap engaging jaws are structurally configured to remain spaced apart from the cap upon insertion, and prior to actuation of the cam arms of the gripper assemblies.

In some configurations, the cap gripping assembly further includes an arm engaging plate engageable with the cam arm. An arm engaging plate biasing member biases the arm engaging plate to direct the cam arms of the gripper assemblies toward the cap receiving opening, and into a disengaged configuration.

In some configurations, the arm engaging plate biasing member comprises a compression spring positioned between an upper surface of the arm engaging plate and an inner surface of the chuck housing.

In some configurations, the cap gripping assembly further includes an arm actuating plate positioned within the central bore. The arm actuating plate is positioned on one side of the cam arms of the gripper assembly with the arm engaging plate on the other side of the cam arms of the gripper assembly to effectively sandwich the cam arms therebetween.

In some configurations, the capping chuck assembly further comprises an ejection assembly positionable within the central bore of the chuck housing. The ejection assembly further comprises an ejection plug having a lower body with a distal end. The ejection plug is slidable relative to the chuck housing along the axis of rotation toward and away from the cap receiving opening. The distal end of the ejection plug is engageable with a cap positioned within the chuck housing to, in turn, force a cap positioned within the chuck housing toward and through the cap receiving opening.

In some configurations, the ejection assembly includes a biasing member associated with each of the chuck housing and the ejector plug. The biasing member biases the ejector plug along the axis of rotation away from the cap receiving opening.

In another aspect of the disclosure, the disclosure is directed to a capping chuck assembly having a chuck housing, a retaining assembly, a cap gripping assembly and an ejection assembly. The chuck housing defines a central bore and a cap receiving opening, structurally configured to receive a cap through the cap receiving opening. The chuck housing further has an axis of rotation extending longitudinally therethrough.

The retaining assembly is coupled to the chuck housing, the retaining assembly and includes a plurality of retaining jaws and a biasing member. The plurality of retaining jaws each have an inner side positionable within the central bore. The retaining jaws are movable at least radially inwardly and outwardly toward and away from an axis of rotation. The biasing member is configured to inwardly biasing the retaining jaws toward the axis of rotation.

The cap gripping assembly is coupled to the chuck housing, and positioned on a side opposite the cap receiving opening from the retaining assembly. The cap gripping assembly includes a plurality of gripper assemblies spaced apart from each other about the axis of rotation within the chuck housing. Each gripper assembly has a cam arm rotatably mounted to the chuck housing with a lever arm portion extending toward the axis of rotation configured to rotate toward and away from the cap receiving opening. An engaging jaw is coupled to the gripper assembly. Rotation of the cam arm away from the cap receiving opening directs the engaging jaw radially toward the axis of rotation.

The ejection assembly is coupled to the chuck housing and positioned on a side opposite the cap gripping assembly from the cap retaining assembly. The cap gripping assembly includes an ejection assembly positionable within the central bore of the chuck housing. The ejection assembly further comprising an ejection plug having a lower body with a distal end. The ejection plug is slidable relative to the chuck housing along the axis of rotation toward and away from the cap receiving opening. The distal end of the ejection plug is engageable with a cap positioned within the chuck housing to, in turn, force a cap positioned within the chuck housing toward and through the cap receiving opening.

In some configurations, the cap gripping assembly further includes an arm engaging plate engageable with the cam arm. An arm engaging plate biasing member biases the arm engaging plate to direct the cam arms of the gripper assemblies toward the cap receiving opening, and into a disengaged configuration.

In some configurations, the cap gripping assembly further includes an arm actuating plate positioned within the central bore. The arm actuating plate is positioned on one side of the cam arms of the gripper assembly with the arm engaging plate on the other side of the cam arms of the gripper assembly to effectively sandwich the cam arms therebetween.

In some configurations, the arm actuating plate further includes a rod extending from the plate away from the cap receiving opening and through an opening in the arm engaging plate.

In some configurations, the ejector plug includes a central bore with the rod of the arm actuating plate extending into the central bore of the ejector plug and with the distal end of the ejector plug extendable through the opening of the arm engaging plate beyond the cam arms of the gripper assemblies so as to be interfaceable with an upper surface of the arm actuating plate.

In some configurations, the ejection assembly includes a biasing member associated with each of the chuck housing and the ejector plug. The biasing member biases the ejector plug along the axis of rotation away from the cap receiving opening.

In some configurations, the biasing member comprises a compression spring.

In some configurations, the plurality of retaining jaws are configured to translate and to move radially relative to the axis of rotation.

In yet another aspect of the disclosure, the disclosure is directed to a method of retaining a cap comprising the steps of: inserting a cap through a cap receiving opening and into a central bore of a capping chuck assembly; retaining the cap with a plurality of retaining jaws, the retaining jaws biased toward the cap; forcing the cap further inward into the central bore to engage a plurality of cam arms and to rotate the cam arms in a direction away from the cap receiving opening; translating a plurality of engaging jaws by the cam arms toward and into contact with the cap; and rotating the capping chuck assembly about an axis of rotation.

In some configurations, prior to the step of forcing, the engaging jaws are spaced apart from the cap.

In some configurations, the retaining jaws are configured to float relative to a cap housing.

BRIEF DESCRIPTION OF THE DRAWINGS

The disclosure will now be described with reference to the drawings wherein.

DETAILED DESCRIPTION OF THE DISCLOSURE

Figure 1:
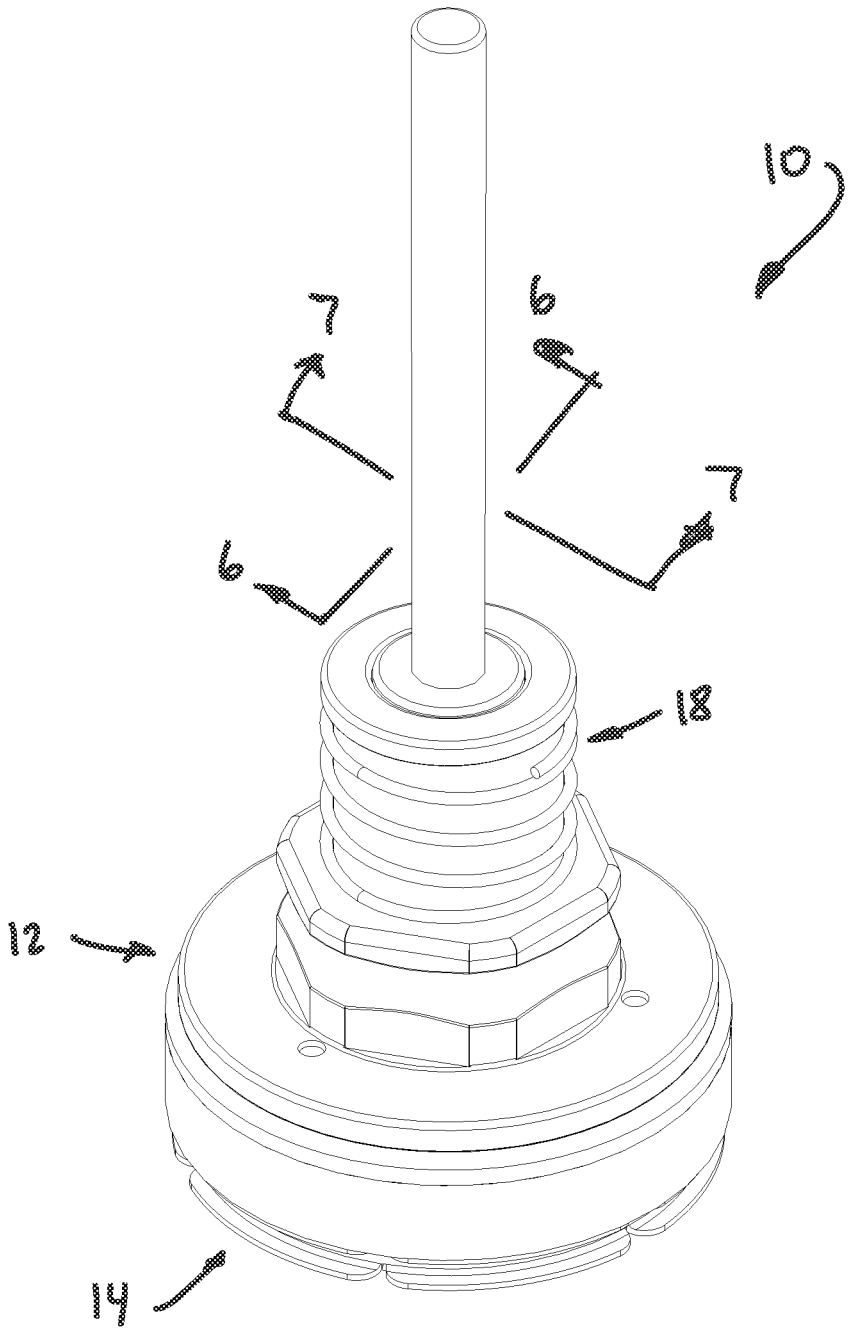
FIG. 1 of the drawings is a top perspective view of a configuration of the capping chuck assembly of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
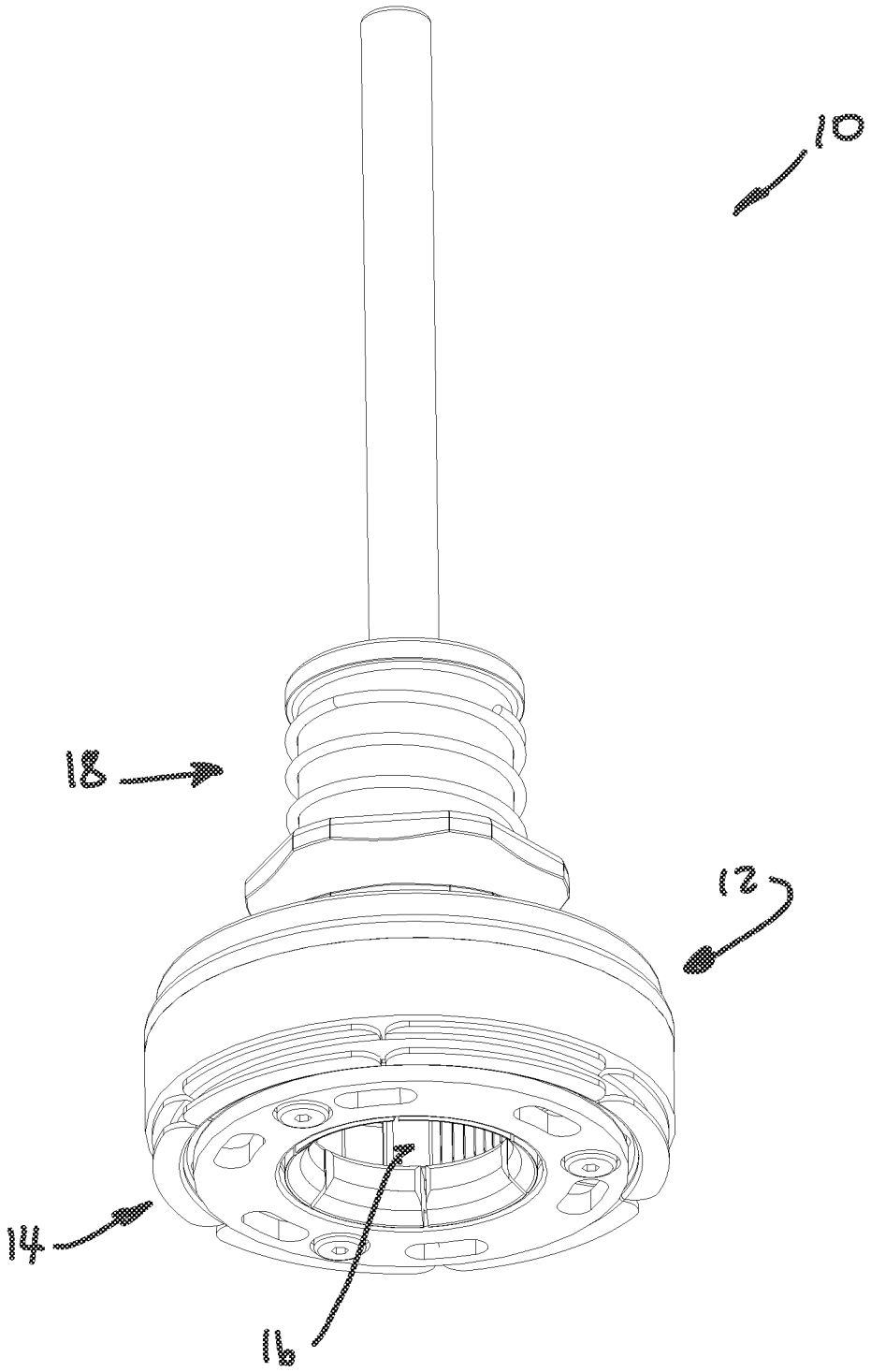
FIG. 2 of the drawings is a bottom perspective view of a configuration of the capping chuck assembly of the present disclosure.
Figure 3:
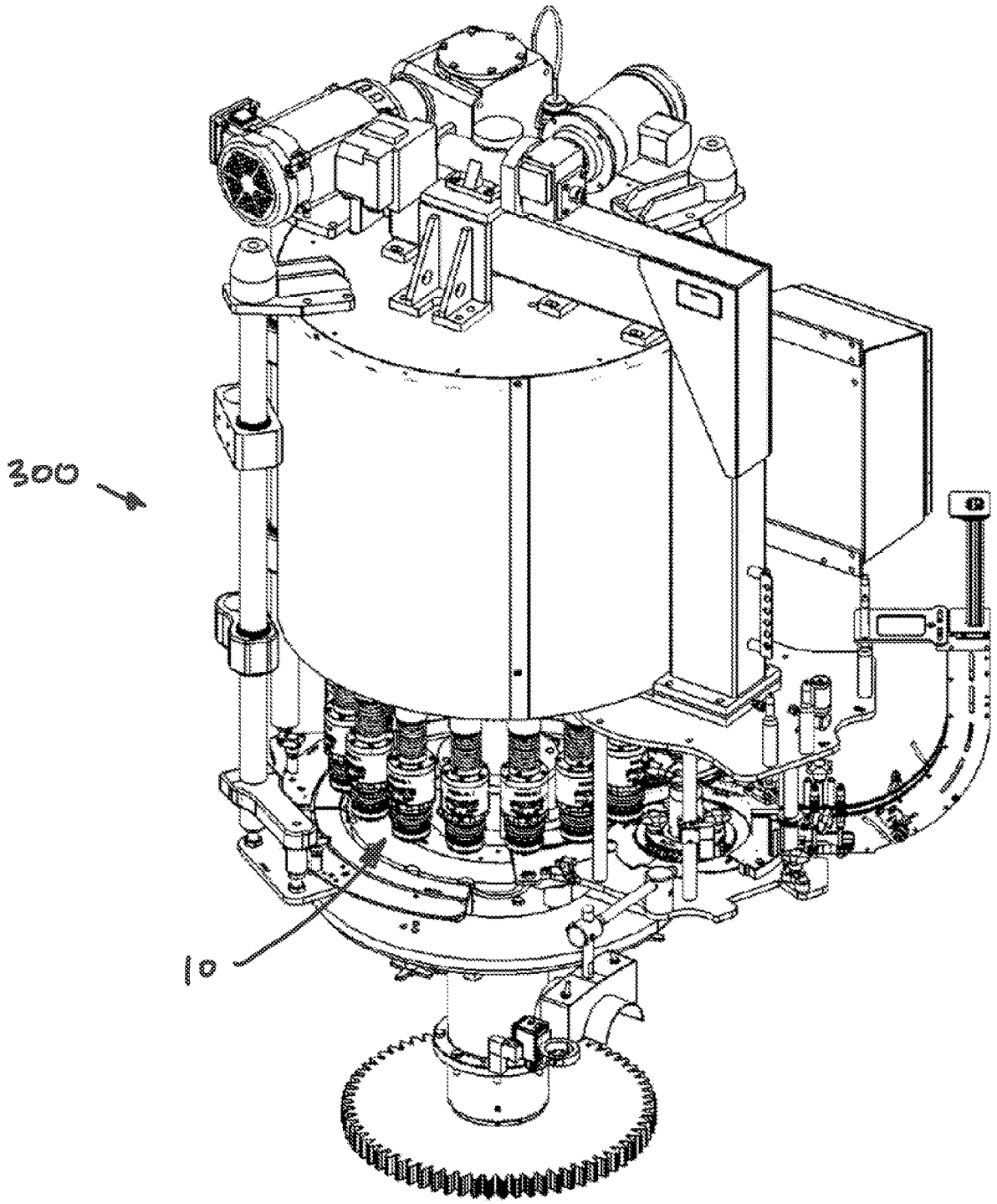
FIG. 3 of the drawings is a perspective view of a capping device having a plurality of capping chuck assemblies of the present disclosure.
Figure 4:
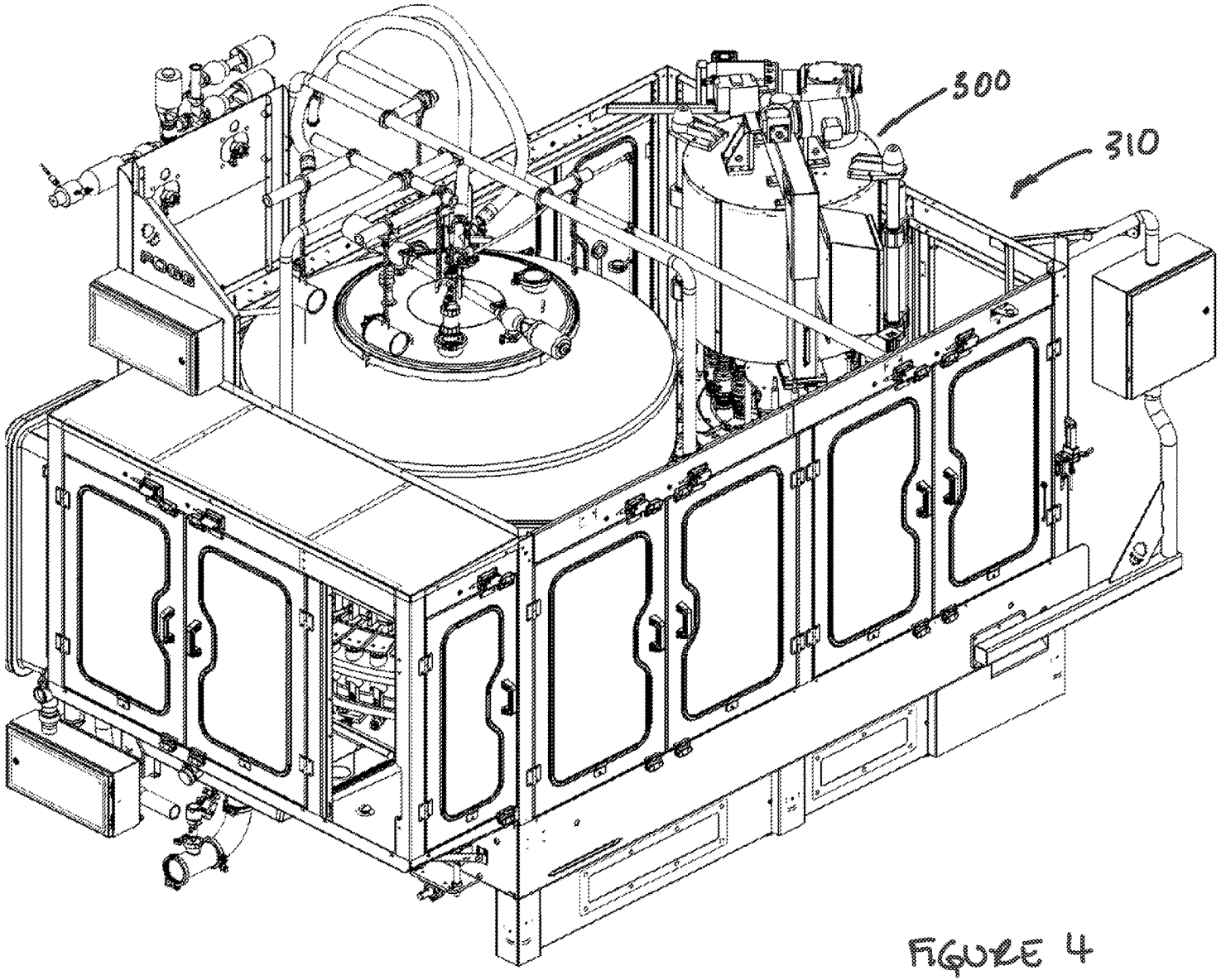
FIG. 4 of the drawings is a perspective view of a filler device having a capping device having a plurality of capping chuck assemblies of the present disclosure.
Figure 5:
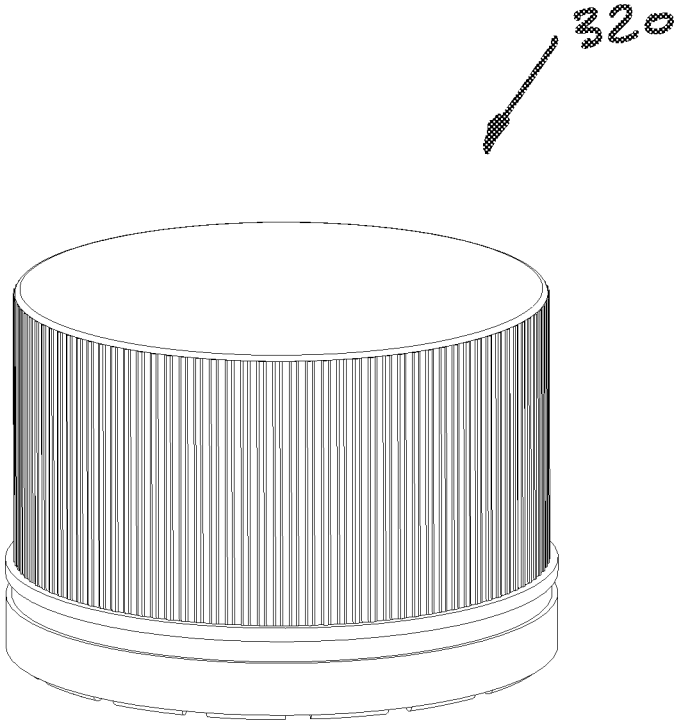
FIG. 5 of the drawings is a perspective view of a cap structurally configured to be interfaceable, retained and released by the capping chuck assembly of the present disclosure.

Referring now to the drawings and in particular to FIGS. 1 and 2, the capping chuck assembly is shown generally at 10. The capping chuck 10 is typically coupled to a capper head that has mechanisms to spin the capping chuck in a clockwise or counterclockwise direction (depending threads). Further, multiple such capper heads (each having a capping chuck assembly) is configured for use in association with a capping device 300 (FIG. 3) having a rotating turret having the capper heads mounted thereto, and which, itself is often associated with a filling device, such as filler device 310 (FIG. 4). The capping device is generally configured for use in association with rigid caps, such as cap 320 (FIG. 5) and typically utilized with rigid packaging, including, but not limited to such bottles and other containers that have flowable material. Such flowable material, by example only, comprises, without limitation, juices, sodas, carbonated beverages, water, syrups, condiments, flavorings, dressings, beverages, oils, industrial products among other flowable material. Indeed, the disclosure is not limited to any particular type of flowable material, any particular type or size of cap or rigid packaging.

It will be understood that the capping device with which the capping chuck may be utilized may utilize a plurality of such capping chucks as explained above (or a plurality of capping chucks, some of which are configured according to the present disclosure). For example, a capper or filler may include 6, 12, 24 or more capper heads in a single installation, with each capper head assembly having a capping chuck assembly. In some configurations multiple capper (capping turrets) may be associated with a single filler, whereas in others, multiple fillers (i.e., filling turrets) may be associated with a single capper.

Figure 6:
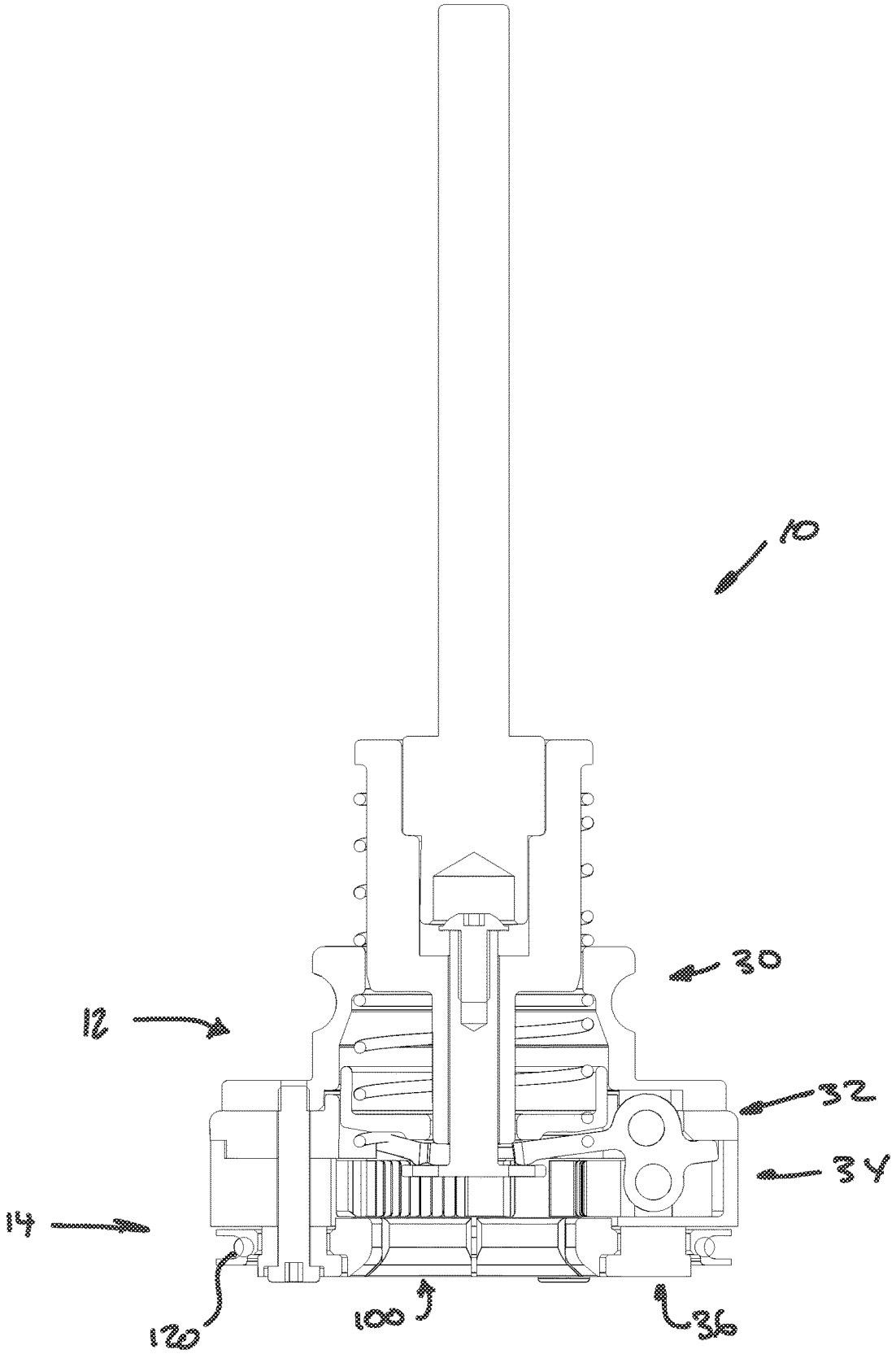
FIG. 6 of the drawings is a cross-sectional view of the capping chuck assembly of the present disclosure, taken generally about lines 6-6 of FIG. 1.
Figure 7:
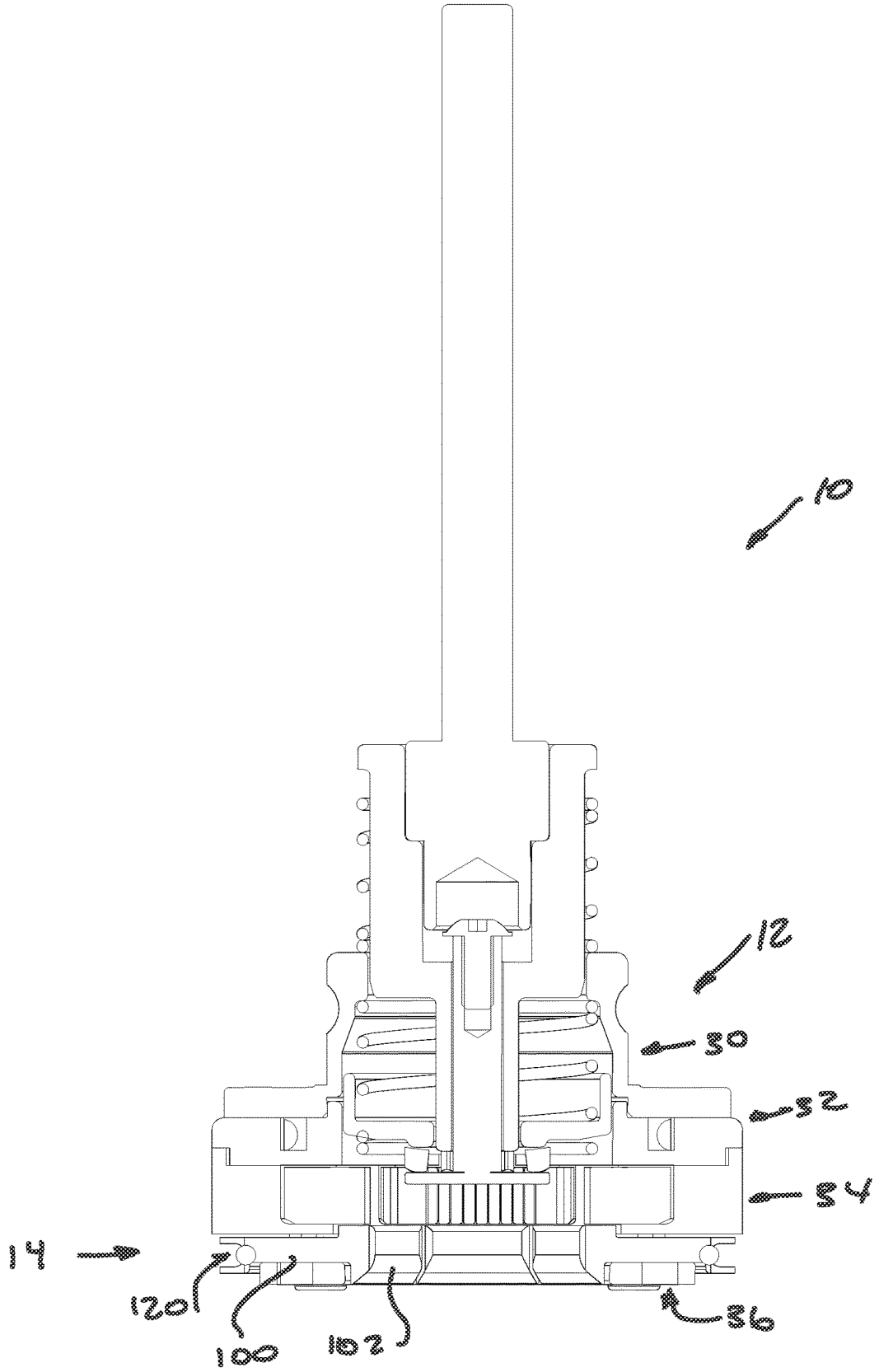
FIG. 7 of the drawings is a cross-sectional view of the capping chuck assembly of the present disclosure, taken generally about lines 7-7 of FIG. 1.
Figure 8:
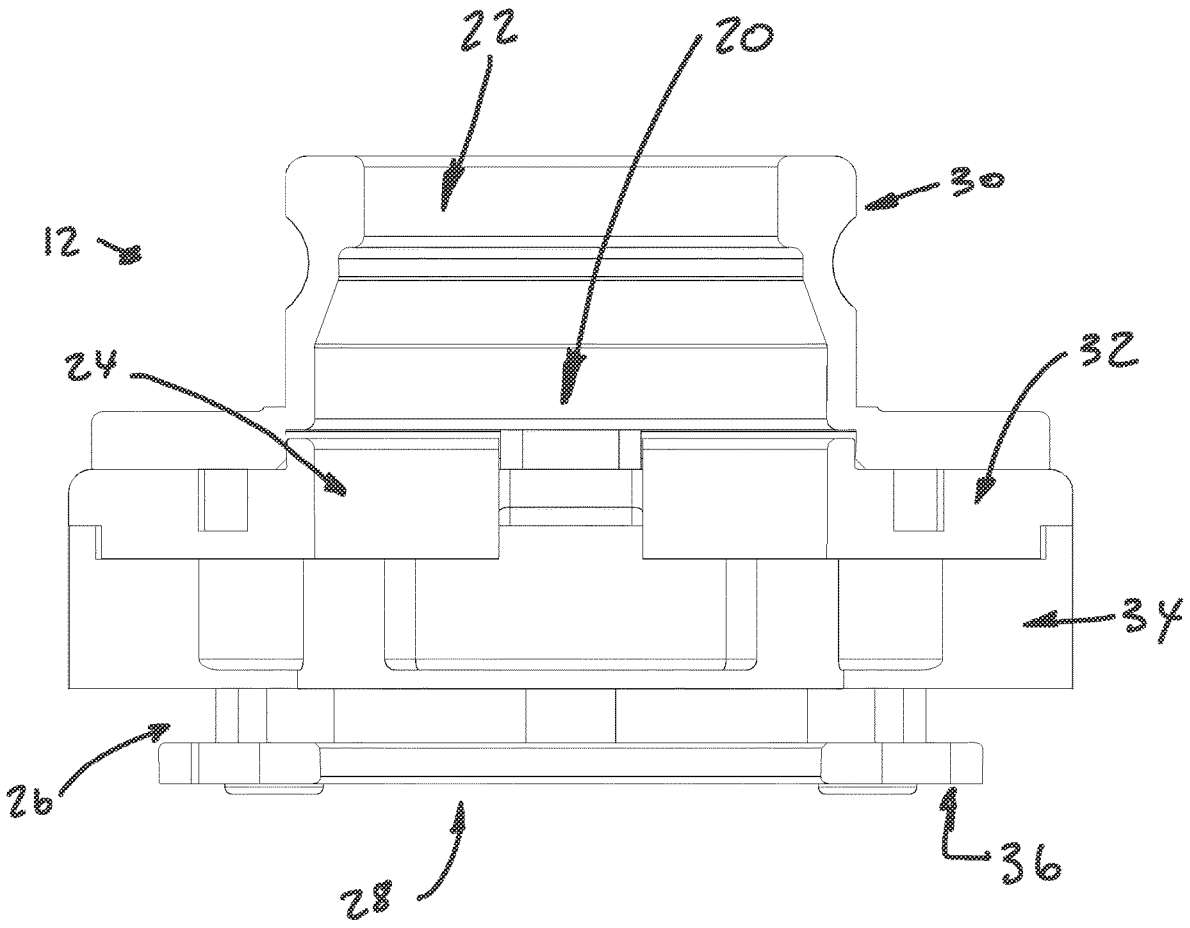
FIG. 8 of the drawings is a cross-sectional view of the chuck housing of the capping chuck assembly of the present disclosure, taken generally about lines 6-6 of FIG. 1.
Figure 9:
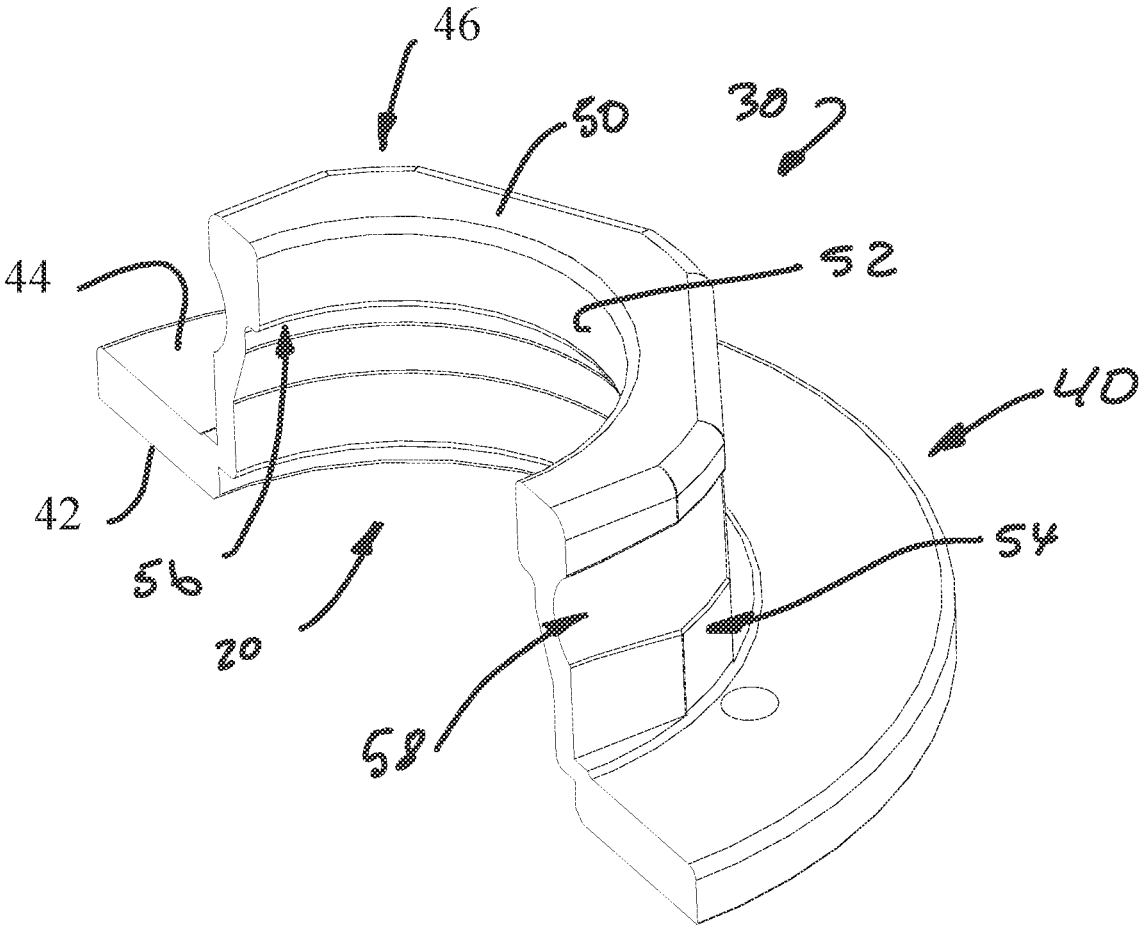
FIG. 9 of the drawings is a perspective cross-sectional view of the upper housing body of the chuck housing shown in FIG. 8.

The capping chuck assembly 10 is shown as comprising chuck housing 12. The chuck housing is shown in greater detail in FIGS. 6, 7 and 8 and collectively defines a central bore 20, an ejector cavity 22, a capper gripping jaw cavity 24, a split retaining jaw cavity 26 and a cap receiving opening 28. As will be explained in greater detail below, the cap receiving opening 28 is structurally configured to receive a cap, which can be retained by structures in the split retaining jaw cavity, other structures in the capper gripping jaw cavity 24. A cap can be ejected (typically to release a cap that is coupled to a bottle) by structures that are in the ejector cavity. Each of such structures will be described below. It will be understood that the foregoing cavities and volumes can be defined in various structures and housing configurations, and the housing configuration described in detail below is but one of a number of different contemplated configurations. It will further be understood that the capping chuck assembly is structurally configured to rotate about an axis of rotation that extends longitudinally through the central bore of the chuck housing and generally through the center of the cap (or through an approximate center of the cap, as some variation of the position of the cap within the chuck is to be anticipated and/or possible within certain tolerances which would be understood to one of skill in the art).

With further reference to FIGS. 9 through 12, collectively and sequentially, the chuck housing 12 includes upper housing body 30, upper spacing ring 32, capper head jaw carrier 34 and lower retaining ring 36. The upper housing body 30 is shown as comprising base flange 40 and cylindrical upstand 46. The base flange includes lower surface 42 and upper surface 44. The base flange includes openings (which may be threaded) to receive fasteners that are utilized to fasten the various structures of the chuck housing (and the capping chuck itself) together.

The cylindrical upstand 46 includes upper end 50 that is distally spaced apart from the base flange, an inner surface and an outer surface. The inner surface 52 includes an upper inner flange 56 (which engages a biasing member, as will be described below). The inner surface defines a central opening 48 (and defines a portion of the ejector cavity and/or the capper gripping jaw cavity) which is a portion of the central bore 20. The outer surface 54 includes a radial slot 58 as well as a plurality of flats (to, for example, define an octagon or other shape that can engage a tool or other structure to preclude relative rotation). The radial slot may be utilized to engage other structures of the capping turret or the capper, preferably, in a tool-less attachment and detachment configuration. It will be understood that the capping chuck is attached to other structures of the capper turret (i.e., capping device) through attachment, in many instances, the chuck housing.

Figure 10:
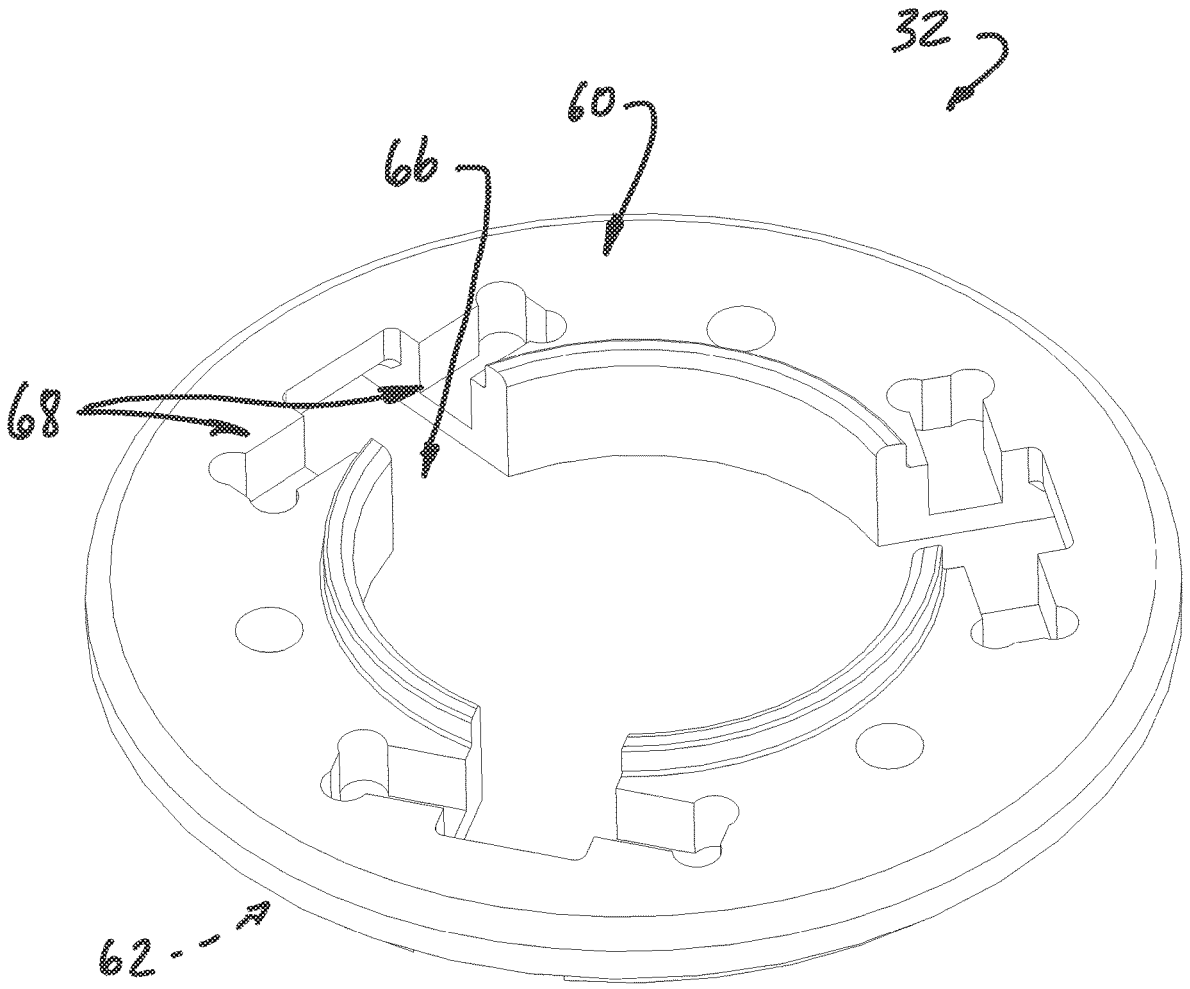
FIG. 10 of the drawings is a perspective view of the upper spacing ring of the chuck housing shown in FIG. 8.
Figure 16:
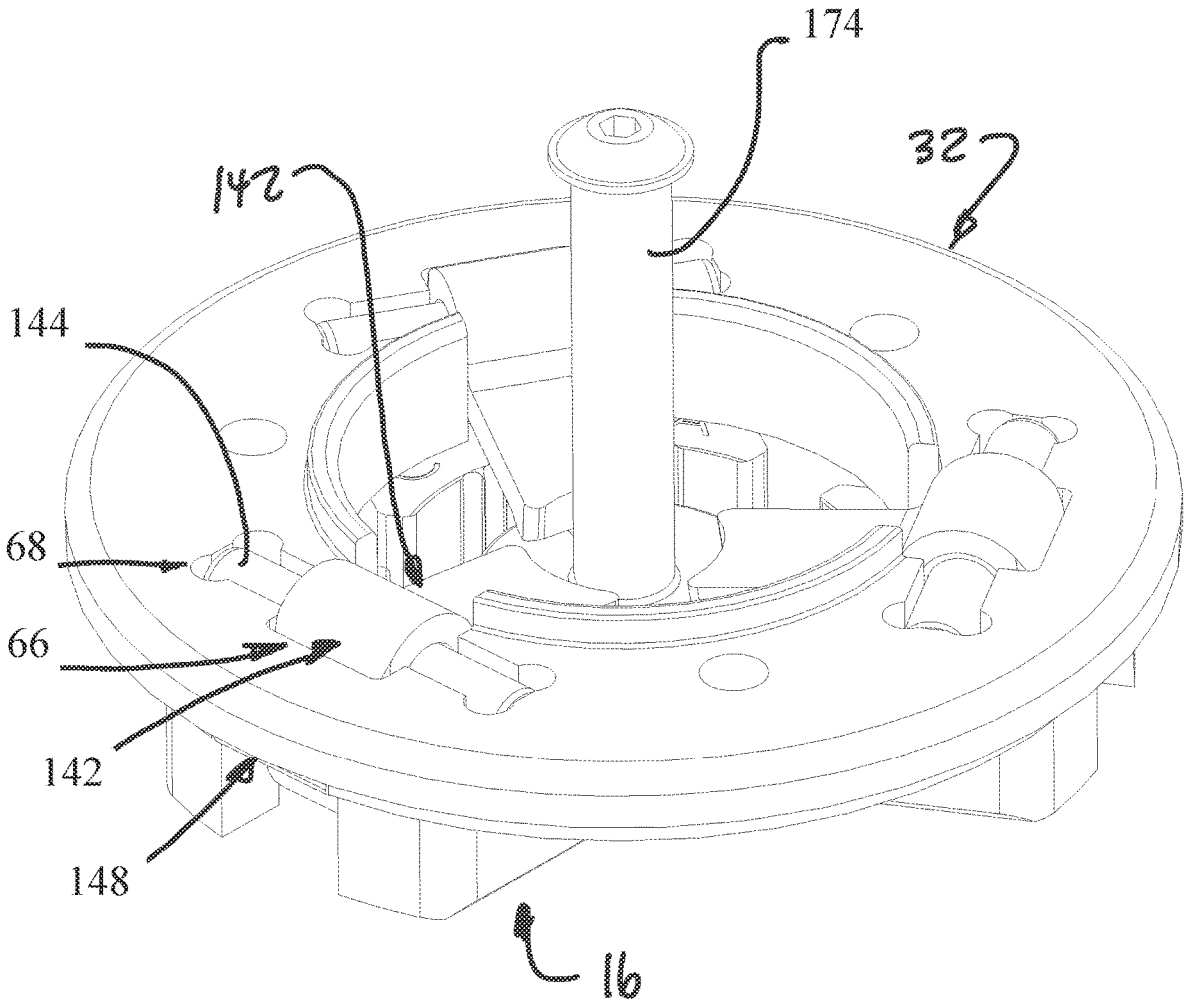
FIG. 16 of the drawings is a perspective view of the cap gripping assembly positioned within the upper spacing ring.
Figure 17:
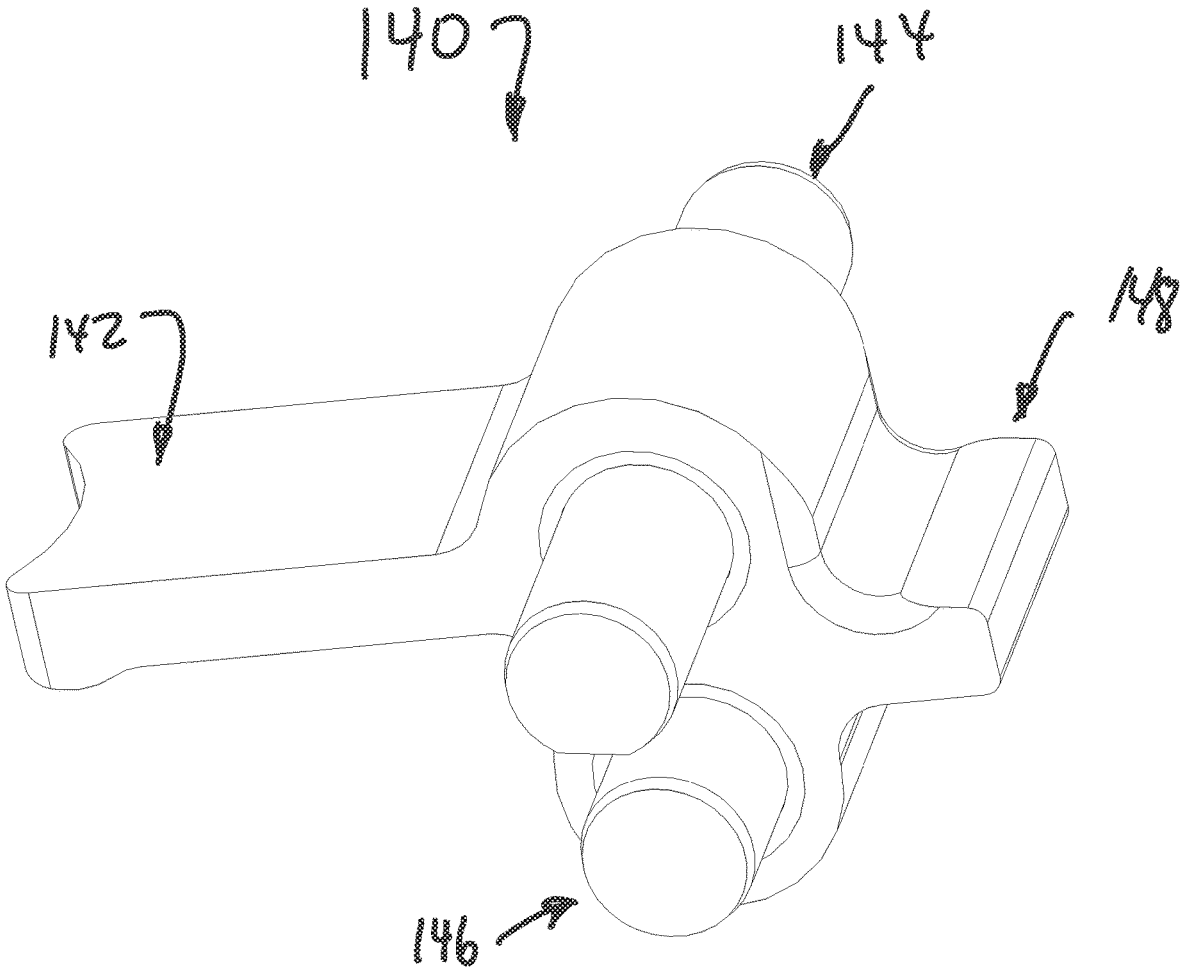
FIG. 17 of the drawings is a perspective view of a cam arm of the gripper assembly of the cap gripping assembly of the present disclosure.

The upper spacing ring 32 is shown in FIG. 10 as comprising upper surface 60, lower surface 62 and a plurality of radial slots, such as radial slot 66, emanating from the central opening 64. In the configuration shown, a total of three radial slots are disclosed as being equally radially spaced about the upper spacing ring, corresponding to the three gripper assemblies 130 of the cap gripping assembly 16 (FIG. 16). In other configurations, greater or fewer radial slots may be present (i.e., as few as one, or as many as six, eight, twelve, or more), depending on the number of gripper assemblies that are utilized (and often related to properties and sizes of the cap and the bottle to which the cap is to be applied).

The radial slot 66 further includes a transverse wing slot with opposing wings 68 extending transversely (i.e., generally perpendicularly) across the radial slots spaced apart from the central opening (and generally parallel to a tangent taken about the central opening at middle of the radial slot). As will be explained below, the cam arm can both rotate about the transverse wing slot and translate through the radial slot of the upper spacing ring. A lip flange may be positioned about the central opening so as to provide a transition to the upper housing body and to align thereto.

Figure 11:
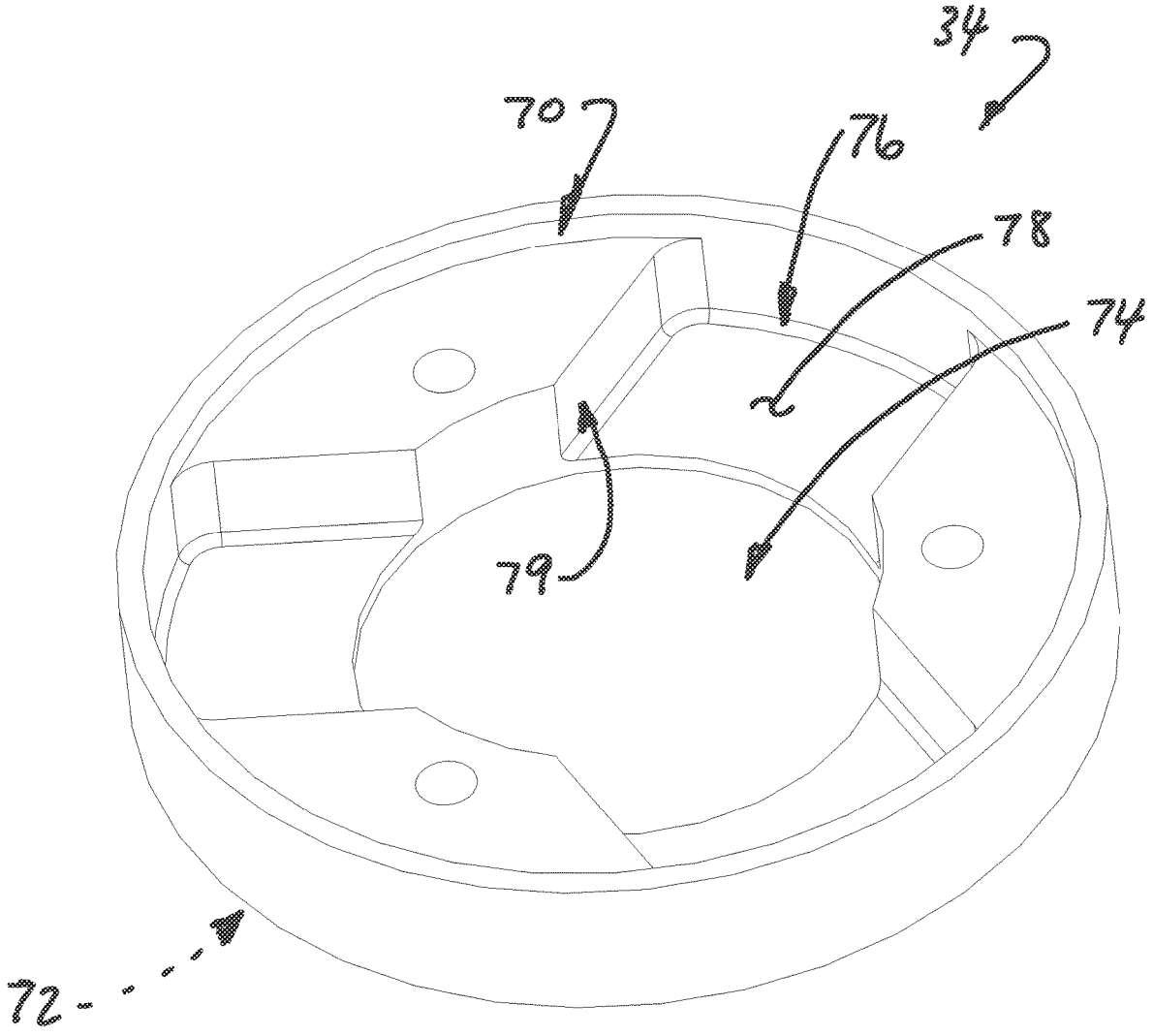
FIG. 11 of the drawings is a perspective view of the capper head jaw carrier of the chuck housing shown in FIG. 8.
Figure 15:
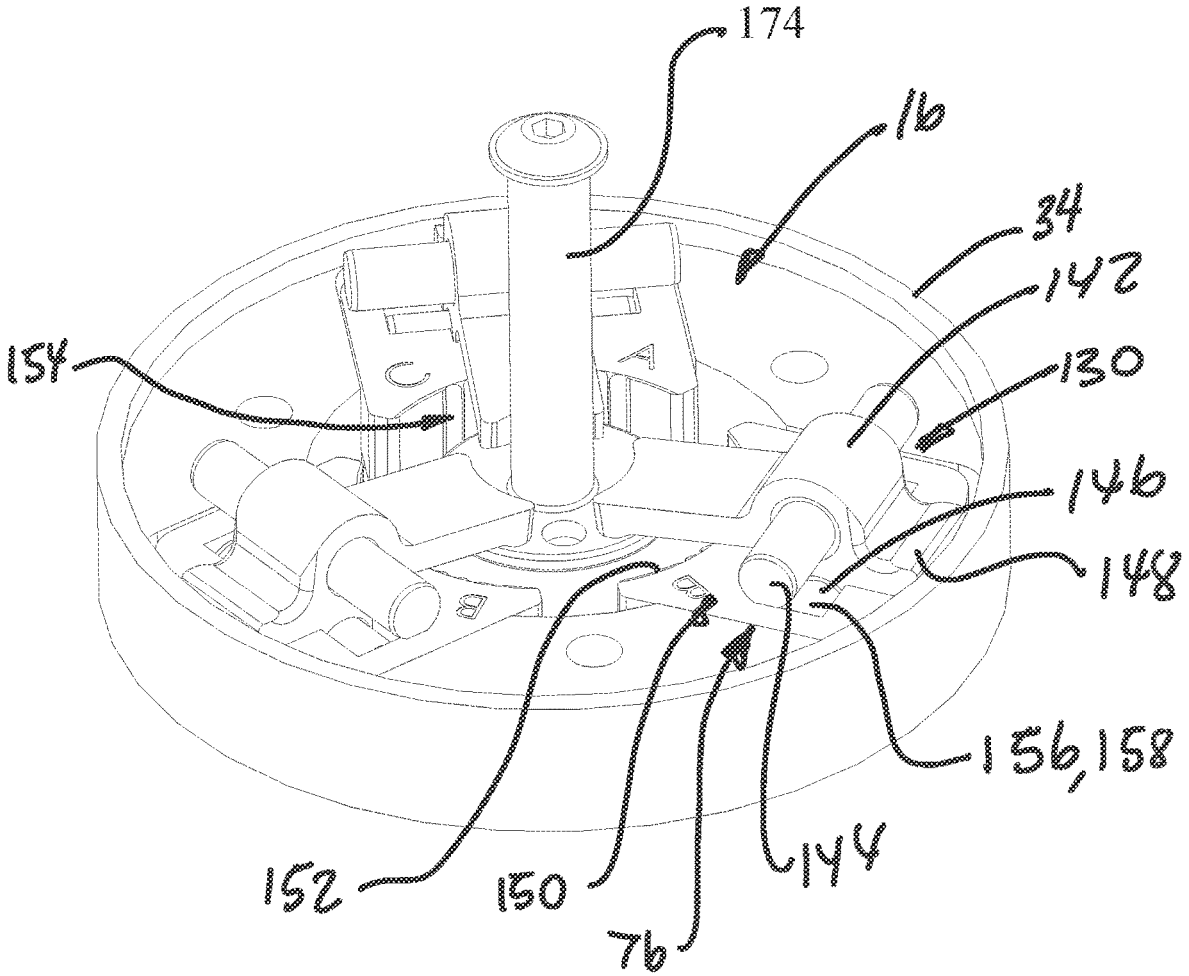
FIG. 15 of the drawings is a perspective view of the cap gripping assembly positioned within the capper head jaw carrier.

The capper head jaw carrier 34 is shown in FIG. 11 as comprising upper surface 70, lower surface 72, central opening 74 and radial channels, such as radial channel 76. The radial channels correspond to the radial slots of the upper spacing ring and align therewith. Each radial channel 76 includes a floor 78 and opposing walls 79 to define a channel that extends radially outward from the central opening 74. As will be explained, the engaging jaws 150 (FIG. 15) slidably translate with the radial channel. As will be understood, multiple radial channels can be presented to correspond to the radial slots, as explained above.

Figure 12:
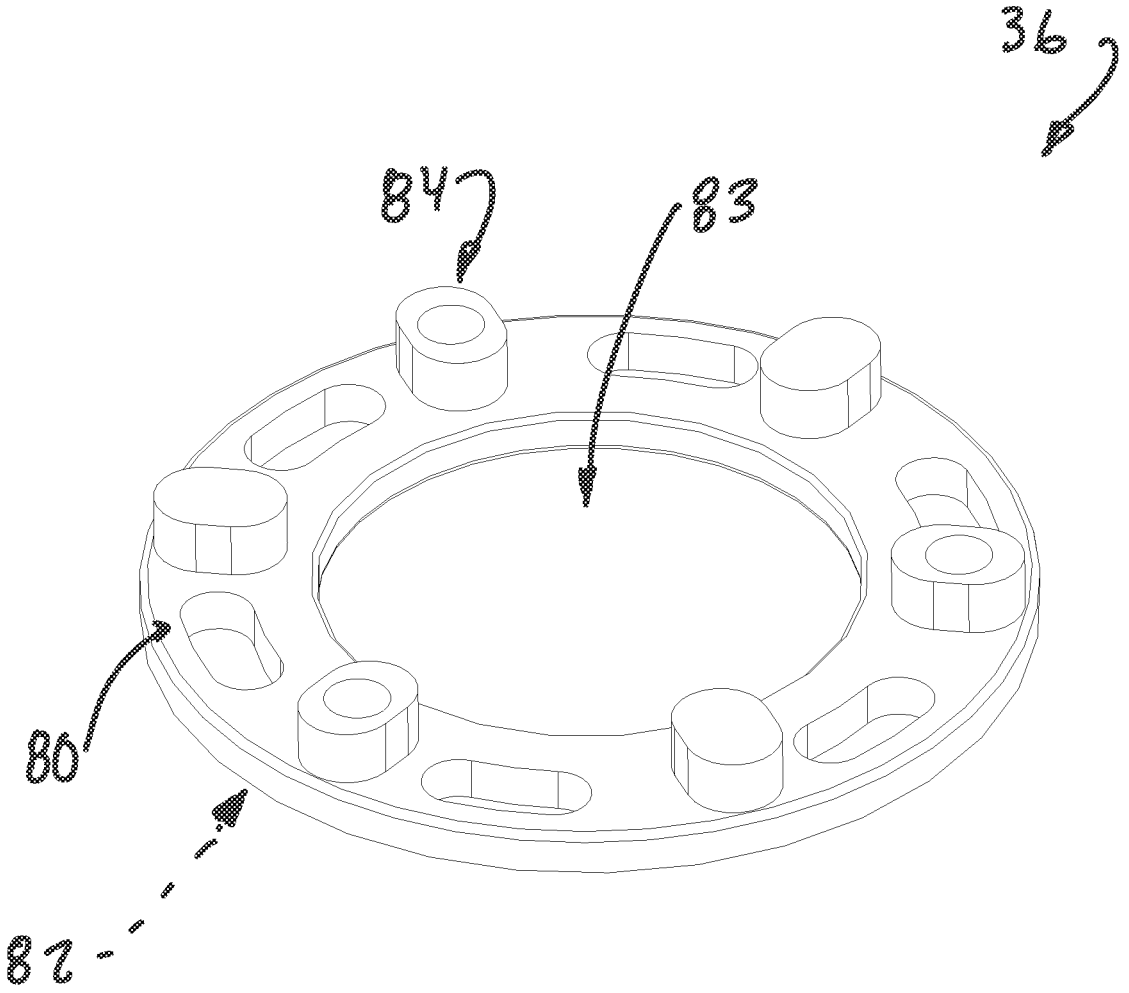
FIG. 12 of the drawings is a perspective view of the lower retaining ring of the chuck housing shown in FIG. 8.

The lower retaining ring 36 is shown in greater detail in FIG. 12 as comprising upper surface 80 and lower surface 82, as well as central opening 83. The upper surface 80 includes a plurality of radial tabs 84 that rise from the upper surface 80. The radial tabs are spaced apart and generally oriented in a radially outward configuration so as to define a plurality of spaces between the tabs. When the lower retaining ring is joined to the capper head jaw carrier, the tabs space the upper surface of the lower retainer ring from the capper head jaw carrier to define a plurality of slots therebetween. As will be explained below, the slots and the tab are configured to receive retaining jaws in relatively movable engagement (i.e., to float relative to the chuck housing).

The upper housing body, the upper spacing ring, the upper head jaw carrier and the lower retaining ring can be stacked and coupled together with fasteners that extend from the lower retaining ring through openings in each of the structures to threaded openings in the upper housing body. In other configurations, differently located fasteners are contemplated for use.

Figure 13:
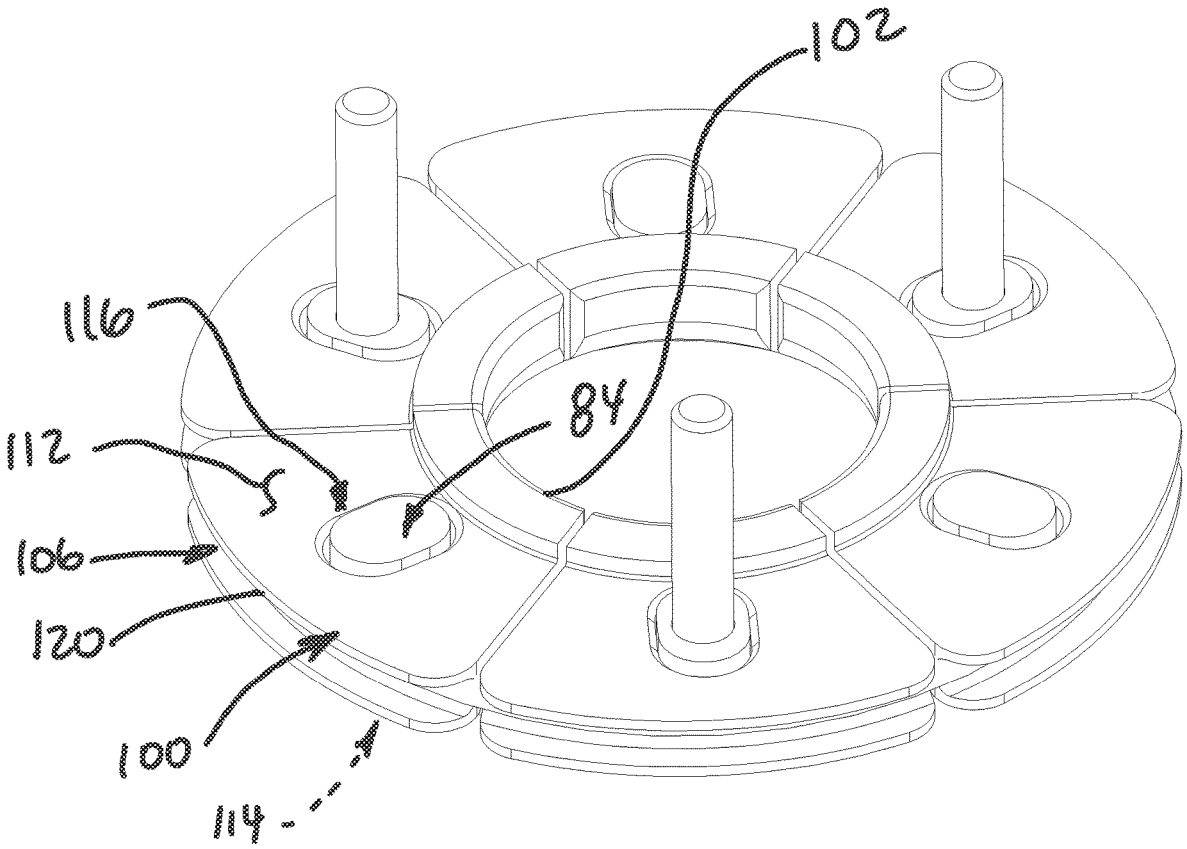
FIG. 13 of the drawings is a perspective view of the retaining assembly of the capping chuck assembly of the present disclosure showing in the lower retaining ring and fasteners associated therewith.
Figure 14:
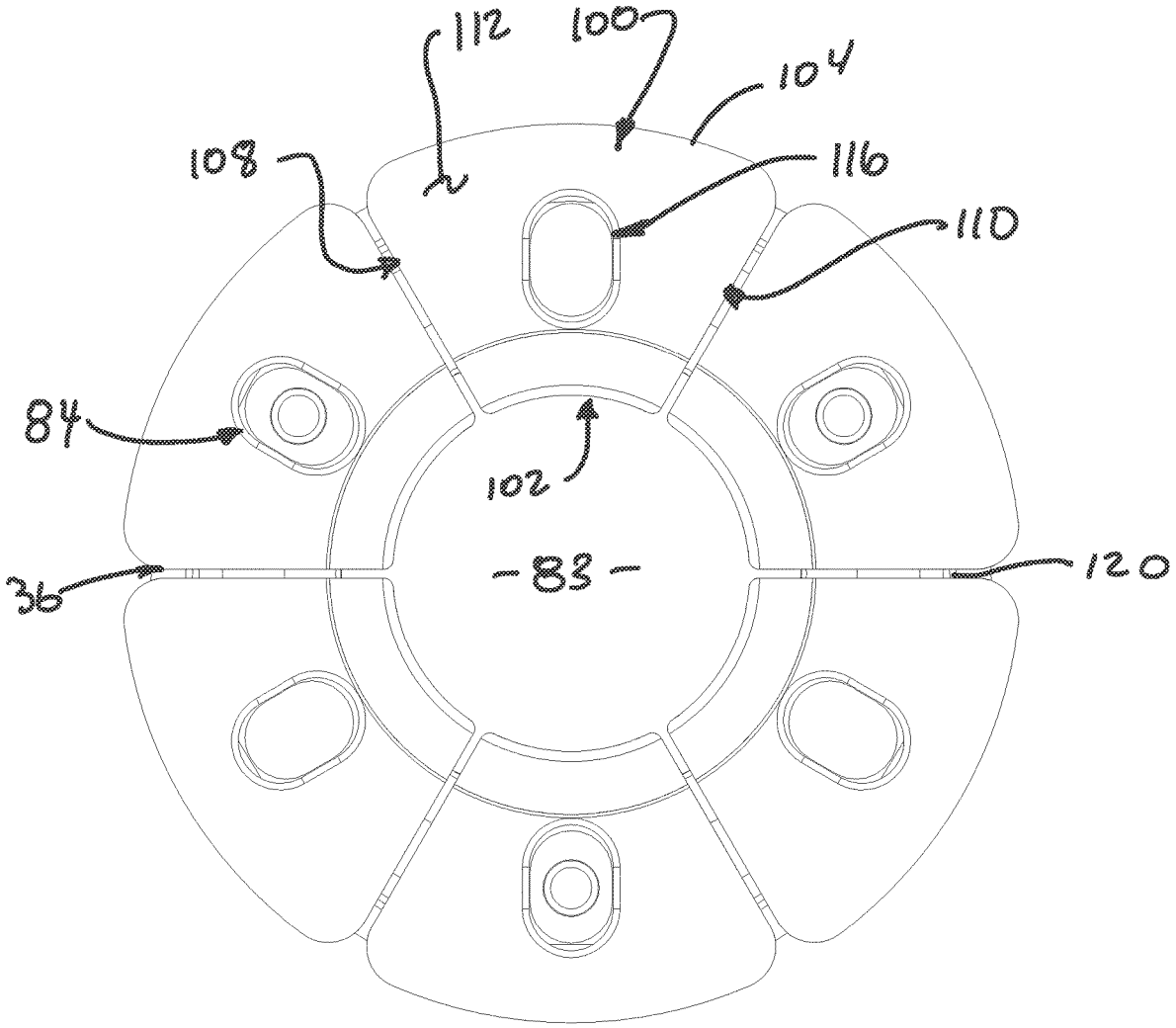
FIG. 14 of the drawings is a bottom plan view of the retaining assembly of the capping chuck assembly of the present disclosure showing the lower retaining ring attached thereto.

With further reference to FIGS. 13 and 14, the retaining assembly 14 is structurally configured to releasably retain a cap (and grasp the cap sufficient to preclude detachment as the cap is being carried from the cap pickup until engagement with the container). The retaining assembly 14 includes retaining jaws, such as retaining jaw 100, and biasing member 120 extending about the retaining jaws. The retaining jaw 100 will be described with the understanding that the remaining jaws are substantially identical. It will be understood that a greater or fewer number of retaining jaws are contemplated for use, including, but not limited to one, two, three, four, seven, eight, or in excess of twelve jaws. Of course, other amounts (other than those specifically identified, are likewise contemplated).

Each of the retaining jaws, such as retaining jaw 100, includes an inner side (i.e., the cap engaging side) 102, outer side 104, first radial side 108, second radial side 110. The sides cooperatively define upper surface 112 and lower surface 114. A tab interfacing bore 116 extends through the upper surface 112 and the lower surface 114. Additionally, a transverse slot 106 extends across the outer side 104.

In the configuration shown, the retaining jaws comprise radial slices that cooperatively define a substantially circular configuration, with the inner sides forming a circular configuration that is smaller than the central opening of the lower retaining ring so as to extend radially inwardly therefrom. The inner side typically has a lower angled lead-in surface that translates to a generally substantially vertical and preferably smooth surface that is to engage a cap. Preferably, the shape mimics the outer surface of the cap with which it is engaged, and defines an outwardly concave configuration. In some configurations, the surface may be knurled, or other than smooth, however, it is preferred that the surface be such that marring of the cap can be minimized.

When assembled, the biasing member 120 can be extended about the outside of the retaining jaws and within the transverse slot of each of the retaining jaws. The biasing member biases the retaining jaws toward the central opening. When assembled with the lower retaining ring, the radial tabs 84 extend through the retaining jaws and permit slidable movement radially inwardly and outwardly, and translating side to side, as well as combinations of the same with or without rotation, collectively which may be referred to as floating within a range of movement. It will be understood that the configuration of the tab interfacing bore 116 and the radial tabs 84 of the lower retaining ring can be modified to allow for different and varying relative movement. In the configuration shown, the biasing member can rest upon or contact the radial tabs in certain orientations of the retaining jaws. In some configurations, the adjacent sides of adjacent retaining jaws can be in contact with each other, or can remain spaced apart, depending on the configuration of the retaining jaws and the radial tabs of the lower retaining ring.

With reference to FIGS. 15 through 19, collectively, the cap gripping assembly 16 is shown as comprising gripper assembly 130, arm engaging plate 132, arm engaging plate biasing member 134 and arm actuating plate 136. As will be explained, the cap gripping assembly is rotatably and/or slidably positionable and retainable by the capper head jaw carrier 34 and the upper spacing ring 32. In the configuration shown, there are a total of three gripper assemblies, such as gripper assembly 130, that are radially spaced apart about the central bore 20 of the chuck housing 12. Each gripper assembly is substantially identical, and, as such, gripper assembly 130 will be described with the understanding that the remaining gripper assemblies are substantially identical and/or similar in configuration.

The gripper assembly 130 includes cam arm 140 and engaging jaw 150. The cam arm 140 includes a lever arm portion 142, a pivot axle 144, a transitioning leg 146 and a stop arm portion 148. The pivot axle and the transition leg are substantially perpendicular to the lever arm portion. The pivot axle is configured to be rotatably positionable within the transverse wing slot 68 of the upper spacing ring 32 of the chuck housing, which allows for the cam arm to rotate about an axis created by the pivot axle within the transverse wing slot. When positioned, the lever arm portion extends into the central bore, with the transitioning leg 146 extending into a radial channel 76 of the capper head jaw carrier 34. The stop arm portion 148 is positioned on the opposite side of the lever arm with the pivot axle positioned therebetween. In the configuration shown, the stop arm portion 148 is engageable with the lower surface of the upper spacing ring 32 to preclude further rotation of the lever arm about the pivot axle (thereby, defining, an outward most position of the translating leg 146—and, as will be explained, the engaging jaw associated therewith).

The engaging jaw 150 associated with the cam arm 140 includes cap engaging surface 152 and arm coupling 156. The cap engaging surface 152 has an outwardly concave configuration (typically mimicking the outer surface of the cap with which the capping chuck is to work) with surface deformations 154. In the configuration shown, the surface deformations 154 comprise knurling and the like which substantially matchingly engage the knurling on the outside of the corresponding cap (to interlock therewith and to substantially preclude relative rotation when the cap is twisted onto a container). The arm coupling 156 comprises a translating slot 158 that extends transversely across the engaging jaw spaced away from the cap engaging surface.

In the assembly, the engaging jaw 150 is positioned in the radial channel 76 so as to be slidably movable radially inwardly and outwardly along the floor 78. The transitioning leg 146 of the cam arm 140 is placed into the translating slot 158 of the engaging jaw, while the pivot axle 144 is positioned within the transverse wing slot 68 of the upper spacing ring. In such a configuration, the lever arm portion 142 is positioned within the radial slot 66. Rotation of the lever arm portion 142 about the pivot axle directs the end of the lever arm portion upwardly and downwardly within the central bore 20 of the chuck housing. At the same time, the rotative movement of the lever arm portion about the pivot axle, rotates the translating leg which is within the translating slot of the arm coupling. Such rotation translates the translating leg relative to the radial channel 76 thereby translating the engaging jaw inwardly and outwardly along the radial channel 76. Preferably, when the cam arm is rotated about the pivot axle 144 until the stop arm portion 148 engages the lower surface of the upper spacing ring (thereby precluding further rotation in the same direction), the position of the cap engaging surface of the engaging jaw is such that it preferably is spaced apart from an outer surface of a cap positioned within the central bore of the chuck housing. As such, in the most retracted position of the cap engaging surface 152, the cap engaging surface and the surface deformations on the surface are precluded from contact with the cap positioned within the chuck housing. In other configurations, the separation can be minimized as desired, while in still other configurations, the cap engaging jaw may touch a cap in the most retracted position.

Figure 18:
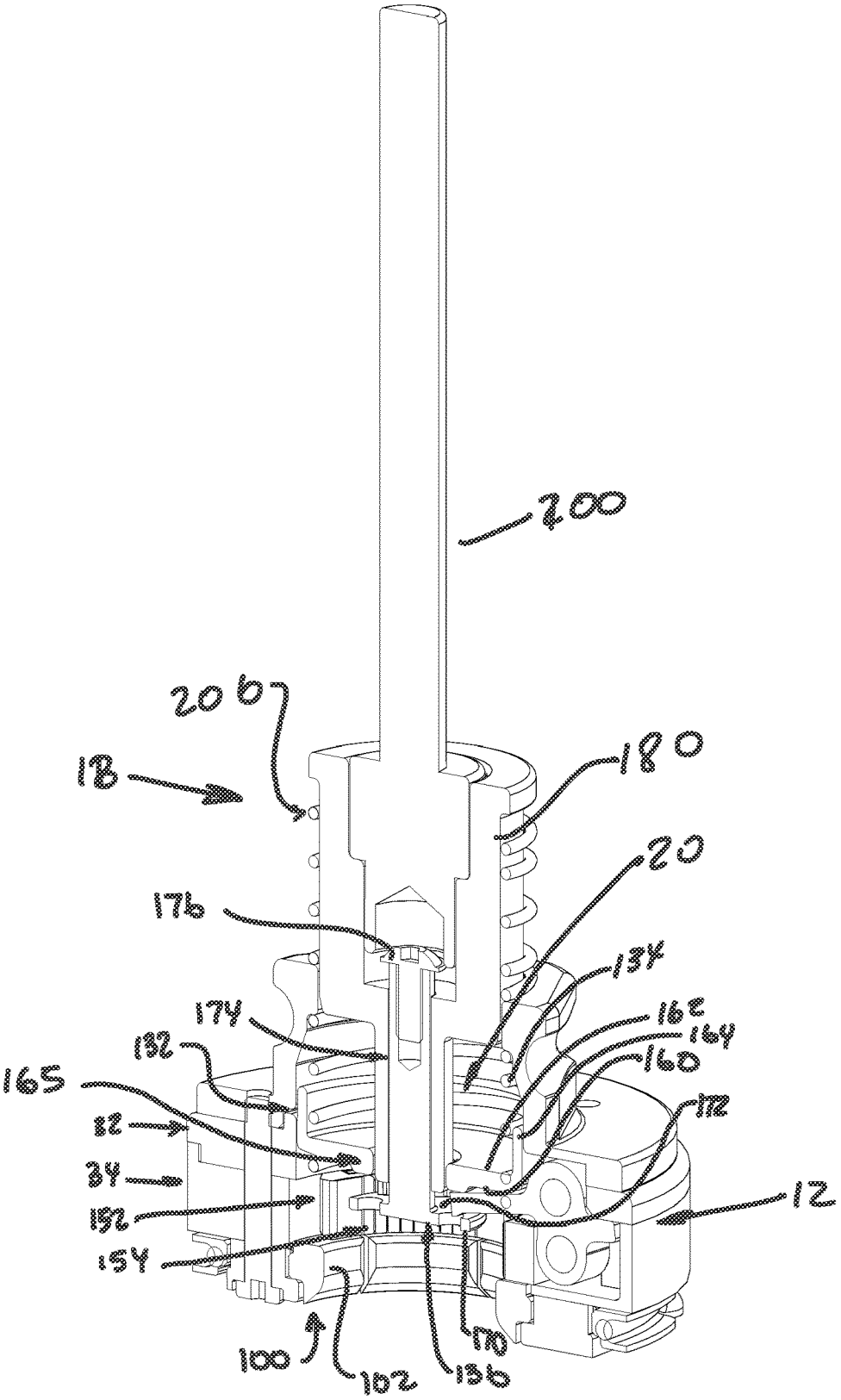
FIG. 18 of the drawings is a perspective cross-sectional view of the capping chuck assembly taken generally about lines 6-6 of FIG. 1.
Figure 19:
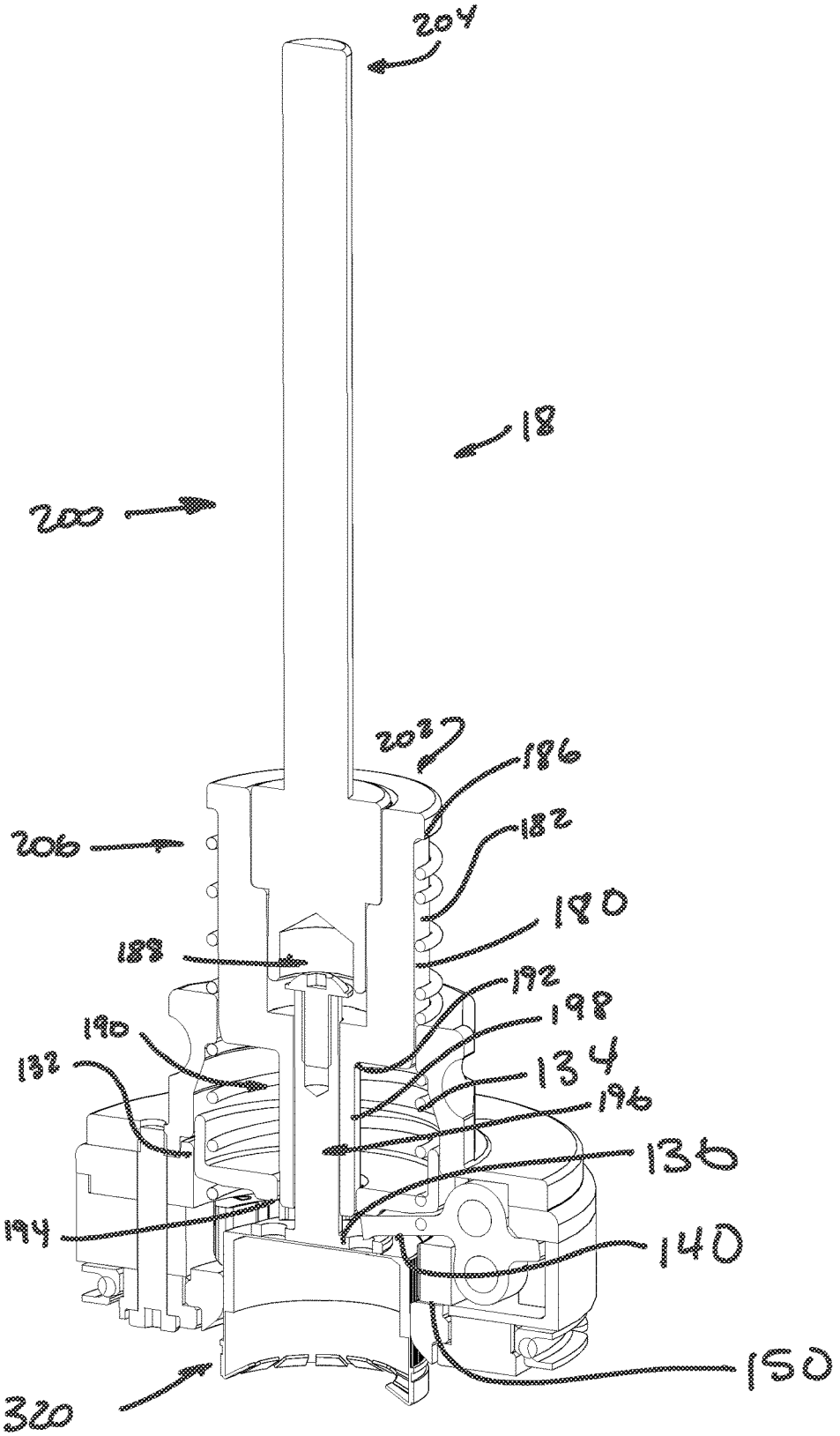
FIG. 19 of the drawings is a perspective cross-sectional view of FIG. 18 with the additional showing of a cap retained by the retaining assembly and spaced apart from the engaging jaws of the cap gripping assembly.

The arm engaging plate 132 is shown in FIGS. 18 and 19 as comprising lower surface 160, upper surface 162 and outer rim 164. An opening 165 extends through the arm engaging plate. The arm engaging plate further includes an arm engaging plate biasing member 134 (which comprises a compression spring in the configuration shown) The biasing member biases against the upper surface 162 and the upper inner flange 56 of the cylindrical upstand of the upper housing body 30 to bias the arm engaging plate into the central bore and in the direction of the cap receiving opening. In turn, the biasing member directs the lower surface 160 into contact with the lever arm portion 142 of the cam arms of the gripper assembly forcing rotation until the stop arm portion 148 engages with the lower surface of the upper spacing ring 32 to preclude further movement.

Arm actuating plate 136 is shown in FIGS. 18 and 19 as comprising lower surface 170, upper surface 172, rod 174 and upper stop 176. The arm actuating plate is positioned on the opposite side of the lever arm from the arm engaging plate, such that the lower surface is abuttingly engageable with a cap that is introduced into the capping chuck. The upper surface is in contact with the lever arm portions of the cam arm of the gripper assemblies. The rod extends through the opening 165 and into the cavity of the ejector plug. The upper stop 176 precludes removal of the rod from slidable engagement with the ejector plug.

Figure 20:
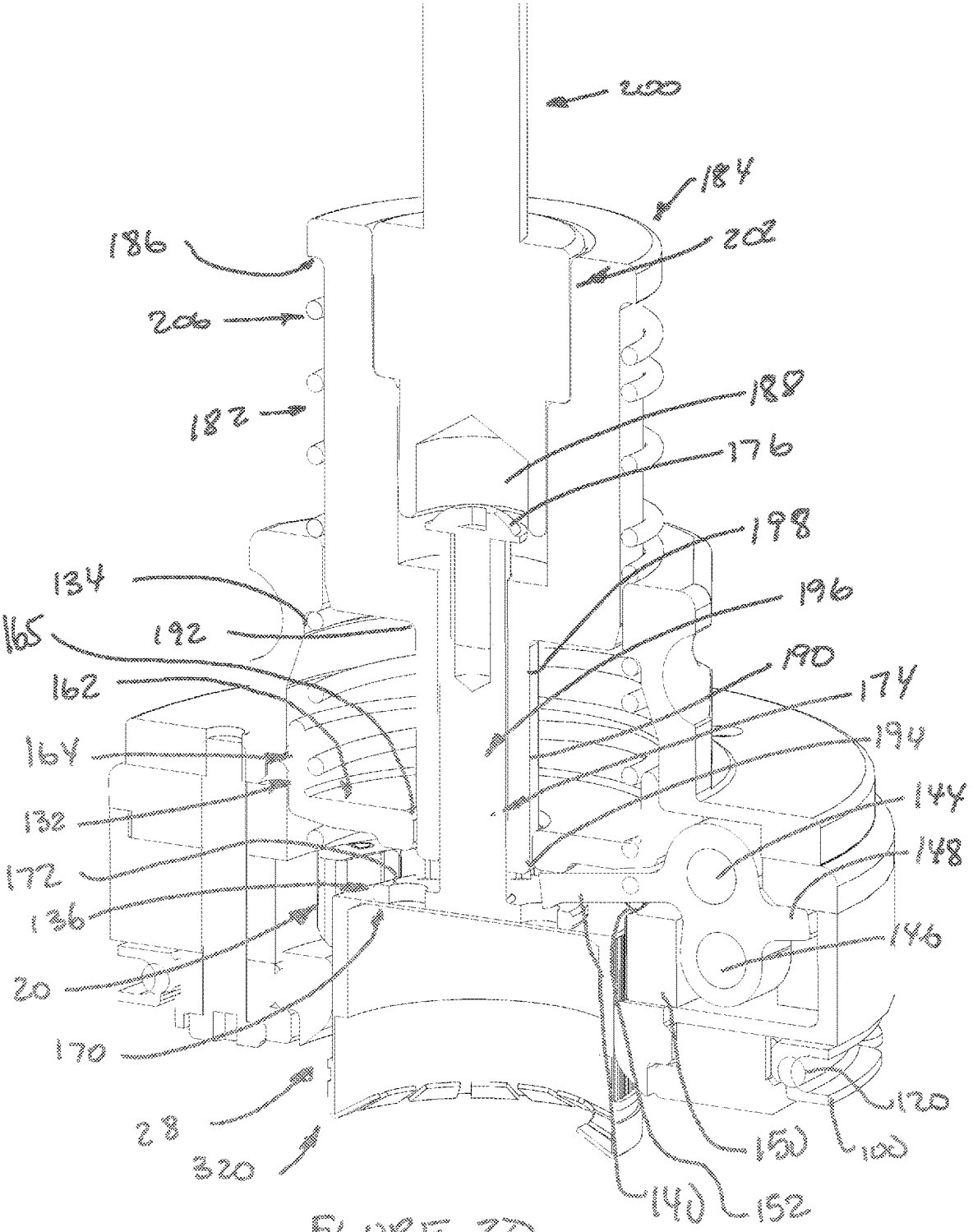
FIG. 20 of the drawings is a partial perspective cross-sectional view of FIG. 19.

The ejection assembly is shown in FIG. 18 through 20 in greater detail as comprising ejector plug 180, rod member 200 and biasing member 206. The ejector plug 180 includes upper body 182 and lower body 190. The upper body 182 includes outer surface 184 having upper flange 186 and central bore 188. The lower body 190 includes proximal end 192, distal end 194, central bore 196 and outer surface 198. The ejector plug is slidably movable through the central bore of the upper housing body 30, with the lower body bting positioned within the cylindrical upstand of the upper housing body. The upper body is sized to substantially correspond (in the general shape of a cylinder) to the configuration of the central bore and the upper opening of the cylindrical upstand. The lower body is concentric with the upper body and has a diameter that is substantially smaller. In the configuration shown, the lower body is sized so that the rod 174 of the arm actuating plate 136 extends through the central bore 196, while the lower body can extend through the opening 165 of the arm engaging plate. The lower body 190 is slidably movable relative to both the rod 174 and the arm engaging plate 132. As will be understood, the upper stop 176 of the rod of the arm actuating plate precludes removal and disconnecting of the slidable telescopic relationship between the rod and the lower body of the ejector plug.

The rod member 200 is coupled to the upper body and extends away from the chuck housing 12. Additionally, the biasing member 206 of the ejection assembly 18 comprises, in the configuration shown, a compression spring that extends about the outer surface of the upper body of the ejector plug between the upper flange 186 of the upper body and the upper end 50 of the cylindrical upstand of the upper housing body to bias the ejector plug away from the chuck housing. It will be understood that by overcoming the biasing force, the ejector plug can be slidably moved relative to the chuck housing such that the distal end 194 of the lower body of the ejector plug can come into contact with the upper surface 172 of the arm actuating plate to direct the plate into the cap and to direct the cap toward the cap receiving opening (to, in turn, disengage the cap from within the capping chuck.

The operation will be explained as progressing from the pickup of a cap and the engagement therewith to a bottle, with eventual twisting of the cap onto the bottle. Specifically, initially, the capping chuck assembly does not have attached thereto. A cap can be first directed into contact and engagement with the capping chuck. In particular, the cap when first picked up engages the retaining jaws of the retaining assembly by contacting the inner side of the retaining jaws. It will be understood that the cap contacts the jaws in any number of different possible positions. As long as the cap contacts the inner side of the jaws, the jaws can translate and rotate relative to each other and relative to the radial tabs 84 of the lower retaining ring to adjust to the position of the cap. The biasing member 120 biases the retaining jaws inward so that they apply a force against the cap. As the cap is directed into the chuck housing, the retaining jaws move to accommodate and receive the cap, with the biasing member applying an inward bias to retain the cap. Advantageously, and preferably, the inner side of the retaining jaw is substantially smooth so as to minimize the possibility of marring the surface of the cap during insertion and engagement of the cap by the retaining jaws of the retaining assembly.

Full insertion of the cap directs the cap upwardly beyond the retaining assembly, within the confines of the cap gripping assembly, and, into abutment with the lower surface 170 of the arm actuating plate 136. At such time, the insertion of the cap does not overcome the biasing force of either the arm engaging plate biasing member 134 or the biasing member 206. As the arm engaging plate biasing member 134 has not been overcome, the biasing member directs the arm engaging plate to engage the cam arms of the gripper assembly to keep the engaging jaws in a disengaged configuration. In such a configuration, the cap engaging surface of the engaging jaws are spaced ever so slightly away from the cap, in the preferred configuration.

The cap is next brought into contact with a spout of a bottle. As the two engage, the capping chuck assembly is forced into the bottle. This engagement of the cap with the bottle forces the cap against the lower surface 170 of the arm actuation plate 136 and overcomes the arm engaging plate biasing member 134. As the biasing member is overcome, the arm engaging plate moves in an upward direction, as toes the arm actuating plate. In turn, the cam arms of the gripper assembly are rotated about the pivot axle, as the distal ends of the lever arm portions are directed upwardly. This rotation of the cam arms rotates the translating legs about the pivot axle, and this rotative movement directs the engaging jaw to translate radially inwardly. Eventually, the cap engaging surface 152 of the engaging jaws engages the outside of the cap with the surface deformations interfacing with the knurling on the outer surface of the cap. Through this interfacing, the cap is precluded from rotation relative to the capping chuck assembly. The cap can then be rotated and directed further toward the bottle wherein the cap is twisted onto the bottle.

Once the process is completed, the capping chuck assembly can be precluded from further movement toward the bottle, and can be moved away from the bottle. Such change in force allows the arm engaging plate biasing member to again direct the arm engaging plate in the direction of the cap receiving opening which returns the gripper assembly to its initial position wherein the cap engaging surface of the engaging jaws is spaced apart from the cap and no longer in contact with the cap.

At the same time, or proximate the same time, the rod member 200 can be directed in a downward direction relative to the chuck housing. As a consequence, the ejector plug is forced toward the chuck housing, overcoming the biasing member 206. This directs the distal end of the lower body beyond the opening 165 of the arm engaging plate and into contact with the upper surface 172 of the arm actuating plate. Further movement of the ejector plug forces the arm actuating plate to push the cap toward the cap receiving opening 28 so as to direct the cap out of the grasp of the retaining assembly 14. At such time, the cap is attached to the bottle, and no longer captured within the capping chuck assembly.

Typically, the capping chuck assembly is mounted on a capping turret and the capping chuck assembly returns to its original configuration ready to grasp and retain a subsequent cap for application thereof to a subsequent bottle.

It will be understood that such a capping process facilitates receipt of a cap while limiting and minimizing marring. The capping process further facilitates the positive retention of the cap by engaging the knurling of the cap to preclude relative rotation of the cap within the capping chuck, again, while minimizing any possibility of marring or destruction of the cap. Furthermore, the capping process facilitates the removal of the cap when twisted onto the bottle, again while minimizing the possibility of marring or destroying the cap.

The capping chuck assembly is shown for use in association with a particularly configured cap. It will be understood that a number of changes can be made to the configuration with respect to size and other dimensional and strength considerations to capture, retain and twist on a number of differently sized and configured caps. For example, and without limitation, the size of the cap may change, the configuration of the knurling on the cap may change, the orientation and pickup positions of the cap may change, as well as the desired forces of the retaining jaws against the cap, the engaging jaws against the cap, the biasing member of the ejection assembly, the arm engaging plate biasing member among other structures. While such variations are contemplated, the application of the cap to the bottle reliably and while minimizing the marring or other damaging of the cap can be minimized.

It will further be understood that such a capping chuck can be retrofit on a number of different capping turrets currently utilized.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A capping chuck assembly comprising:

a chuck housing defining a central bore and a cap receiving opening, structurally configured to receive a cap through the cap receiving opening, and having an axis of rotation extending longitudinally therethrough;

a retaining assembly coupled to the chuck housing, the retaining assembly including:

a plurality of retaining jaws each having an inner side positionable within the central bore, the retaining jaws movable at least radially inwardly and outwardly toward and away from the axis of rotation; and a biasing member inwardly biasing the retaining jaws toward the axis of rotation into a normally inward cap engaging position; and a cap gripping assembly coupled to the chuck housing, and positioned on a side opposite the cap receiving opening from the retaining assembly, the cap gripping assembly including:

a plurality of gripper assemblies spaced apart from each other about the axis of rotation and within the chuck housing, each gripper assembly having a cam arm rotatably mounted to the chuck housing with a lever arm portion extending toward the axis of rotation configured to rotate toward and away from the cap receiving opening, and an engaging jaw coupled to the gripper assembly, whereupon a rotation of the cam arm away from the cap receiving opening directs the engaging jaw radially toward the axis of rotation.

2. The capping chuck assembly of claim 1 wherein the plurality of retaining jaws have an inner side that is smooth and substantially free of surface deformations.

3. The capping chuck assembly of claim 2 wherein the cap engaging jaw further includes a cap engaging surface having at least one surface deformation structurally configured to engage a knurling of a cap, to, in turn, limit relative rotation of the cap engaging jaw and the cap.

4. The capping chuck assembly of claim 1 wherein the cap engaging jaws further include a disengaged configuration wherein the cap engaging surfaces of the cap engaging jaws are structurally configured to remain spaced apart from the cap upon insertion, and prior to actuation of the cam arms of the gripper assemblies.

5. The capping chuck assembly of claim 1 wherein the cap gripping assembly further includes an arm engaging plate engageable with the cam arm, with an arm engaging plate biasing member biasing the arm engaging plate to direct the cam arms of the gripper assemblies toward the cap receiving opening, and into a disengaged configuration.

6. The capping chuck assembly of claim 5 wherein the arm engaging plate biasing member comprises a compression spring positioned between an upper surface of the arm engaging plate and an inner surface of the chuck housing.

7. The capping chuck assembly of claim 5 wherein the cap gripping assembly further includes an arm actuating plate positioned within the central bore, the arm actuating plate being positioned on one side of the cam arms of the gripper assembly with the arm engaging plate on the other side of the cam arms of the gripper assembly to effectively sandwich the cam arms therebetween.

8. The capping chuck assembly of claim 1 further comprising an ejection assembly positionable within the central bore of the chuck housing, the ejection assembly further comprising an ejection plug having a lower body with a distal end, the ejection plug being slidable relative to the chuck housing along the axis of rotation toward and away from the cap receiving opening, the distal end of the ejection plug engageable with the cap positioned within the chuck housing to, in turn, force a cap positioned within the chuck housing toward and through the cap receiving opening.

9. The capping chuck assembly of claim 8 wherein the ejection assembly includes a biasing member associated with each of the chuck housing and the ejector plug, the biasing member biasing the ejector plug along the axis of rotation away from the cap receiving opening.

10. A capping chuck assembly comprising:

a chuck housing defining a central bore and a cap receiving opening, structurally configured to receive a cap through the cap receiving opening, and having an axis of rotation extending longitudinally therethrough;

a retaining assembly coupled to the chuck housing, the retaining assembly including:

a plurality of retaining jaws each having an inner side positionable within the central bore, the retaining jaws movable at least radially inwardly and outwardly toward and away from the axis of rotation;

a biasing member inwardly biasing the retaining jaws toward the axis of rotation into a normally inward cap engaging position;

a cap gripping assembly coupled to the chuck housing, and positioned on a side opposite the cap receiving opening from the retaining assembly, the cap gripping assembly including:

a plurality of gripper assemblies spaced apart from each other about the axis of rotation and within the chuck housing, each gripper assembly having a cam arm rotatably mounted to the chuck housing with a lever arm portion extending toward the axis of rotation configured to rotate toward and away from the cap receiving opening, and an engaging jaw coupled to the gripper assembly, whereupon rotation of the cam arm away from the cap receiving opening directs the engaging jaw radially toward the axis of rotation; and an ejection assembly coupled to the chuck housing and positioned on a side opposite the cap gripping assembly from the cap retaining assembly, the cap gripping assembly including an ejection assembly positionable within the central bore of the chuck housing, the ejection assembly further comprising an ejection plug having a lower body with a distal end, the ejection plug being slidable relative to the chuck housing along the axis of rotation toward and away from the cap receiving opening, the distal end of the ejection plug engageable with a cap positioned within the chuck housing to, in turn, force a cap positioned within the chuck housing toward and through the cap receiving opening.

11. The capping chuck assembly of claim 10 wherein the cap gripping assembly further includes an arm engaging plate engageable with the cam arm, with an arm engaging plate biasing member biasing the arm engaging plate to direct the cam arms of the gripper assemblies toward the cap receiving opening, and into a disengaged configuration.

12. The capping chuck assembly of claim 11 wherein the cap gripping assembly further includes an arm actuating plate positioned within the central bore, the arm actuating plate being positioned on one side of the cam arms of the gripper assembly with the arm engaging plate on the other side of the cam arms of the gripper assembly to effectively sandwich the cam arms therebetween.

13. The capping chuck assembly of claim 12 wherein the arm actuating plate further includes a rod extending from the plate away from the cap receiving opening and through an opening in the arm engaging plate.

14. The capping chuck assembly of claim 13 wherein the ejector plug includes a central bore with the rod of the arm actuating plate extending into the central bore of the ejector plug with the distal end of the ejector plug extendable through the opening of the arm engaging plate beyond the cam arms of the gripper assemblies and interfaceable with an upper surface of the arm actuating plate.

15. The capping chuck assembly of claim 10 wherein the ejection assembly includes a biasing member associated with each of the chuck housing and the ejector plug, the biasing member biasing the ejector plug along the axis of rotation away from the cap receiving opening.

16. The capping chuck assembly of claim 15 wherein the biasing member comprises a compression spring.

17. The capping chuck assembly of claim 10 wherein the plurality of retaining jaws are configured to translate and to move radially relative to the axis of rotation.

18. A capping chuck assembly comprising:

a chuck housing defining a central bore and a cap receiving opening, structurally configured to receive a cap through the cap receiving opening, and having an axis of rotation extending longitudinally therethrough;

a retaining assembly coupled to the chuck housing, the retaining assembly including:

a plurality of retaining jaws each having an inner side positionable within the central bore, the retaining jaws movable at least radially inwardly and outwardly toward and away from the axis of rotation; and a biasing member inwardly biasing the retaining jaws toward the axis of rotation into a normally inward position for engagement with a cap as the cap enters the cap receiving opening such that the cap will move the retaining jaws radially outward against the biasing of the biasing member; and a cap gripping assembly coupled to the chuck housing, and positioned on a side opposite the cap receiving opening from the retaining assembly, the cap gripping assembly including:

a plurality of gripper assemblies spaced around the axis of rotation and within the chuck housing, each gripper assembly having a cam arm rotatably mounted to the chuck housing with a lever arm portion extending toward the axis of rotation and configured to rotate toward and away from the cap receiving opening, and an engaging jaw coupled to the gripper assembly, whereupon a rotation of the cam arm away from the cap receiving opening directs the engaging jaw radially toward the axis of rotation, wherein both the cam arm and the engaging jaw are within the chuck housing.

* * * * *